US010609474B2

(12) United States Patent
Liang et al.

(10) Patent No.: US 10,609,474 B2
(45) Date of Patent: Mar. 31, 2020

(54) AIR PULSE GENERATING ELEMENT AND MANUFACTURING METHOD THEREOF

(71) Applicant: xMEMS Labs, Inc., Saratoga, CA (US)

(72) Inventors: Jemm Yue Liang, Sunnyvale, CA (US); Chiung C. Lo, San Jose, CA (US); Wen-Chien Chen, New Taipei (TW); Chun-I Chang, Hsinchu County (TW)

(73) Assignee: xMEMS Labs, Inc., Los Altos, CA (US)

( * ) Notice: Subject to any disclaimer, the term of this patent is extended or adjusted under 35 U.S.C. 154(b) by 0 days.

(21) Appl. No.: 16/161,097

(22) Filed: Oct. 16, 2018

(65) Prior Publication Data

US 2019/0116417 A1 Apr. 18, 2019

Related U.S. Application Data

(60) Provisional application No. 62/652,908, filed on Apr. 5, 2018, provisional application No. 62/719,694, filed (Continued)

(51) Int. Cl.
*H04R 1/32* (2006.01)
*H04R 9/06* (2006.01)

(Continued)

(52) U.S. Cl.
CPC ..... *H04R 1/323* (2013.01); *G10K 9/121* (2013.01); *G10K 9/122* (2013.01); *G10K 9/13* (2013.01);

(Continued)

(58) Field of Classification Search
CPC ..... H04R 1/323; H04R 9/063; H04R 17/005; H04R 7/14; H04R 19/02; H04R 19/005;

(Continued)

(56) References Cited

U.S. PATENT DOCUMENTS 3,846,792 A 11/1974 Haigh
5,146,434 A 9/1992 Bromley (Continued)

FOREIGN PATENT DOCUMENTS

KR 10-2017-0011795 A 2/2017
KR 10-2018-0030784 A 3/2018
WO 2016/202790 A2 12/2016

OTHER PUBLICATIONS

Jemm Yue Liang et al., Title: Sound Producing Device, pending U.S. Appl. No. 16/406,033, filed May 8, 2019.

(Continued)

*Primary Examiner* — Tuan D Nguyen
(74) *Attorney, Agent, or Firm* — Winston Hsu

(57) ABSTRACT

An air pulse generating element is disclosed. The air pulse generating element includes a front faceplate; a back faceplate; a front supporting element; a back supporting element; a folded membrane, configured to form a front chamber and a back chamber, and comprising a plurality of membrane units; wherein the plurality of membrane units are parallel and sequentially connected and an end of the folded membrane is connected to the back faceplate via the back supporting element and another end of the folded membrane is connected to the front faceplate via the front supporting element; and a plurality of valves controlling a plurality of air flow channels between the front chamber toward either a front space or a back space; wherein the plurality of membrane units are configured to perform horizontal deformation to squeeze air in and out of the front or back chamber with operations of the plurality of valves.

14 Claims, 21 Drawing Sheets

Related U.S. Application Data on Aug. 19, 2018, provisional application No. 62/574,089, filed on Oct. 18, 2017, provisional application No. 62/722,085, filed on Aug. 23, 2018.

(51) Int. Cl.

| | |
|---|---|
| ***G10K 9/13*** | (2006.01) |
| ***H04R 7/14*** | (2006.01) |
| ***G10K 9/12*** | (2006.01) |
| ***G10K 9/122*** | (2006.01) |
| *H04R 19/00* | (2006.01) |
| *H04R 19/02* | (2006.01) |
| *H04R 17/00* | (2006.01) |

(52) U.S. Cl.
CPC ..... *H04R 7/14* (2013.01); *H04R 9/063* (2013.01); *H04R 17/005* (2013.01); *H04R 19/005* (2013.01); *H04R 19/02* (2013.01)

(58) Field of Classification Search
CPC ..... H04R 2231/001; H04R 31/003; G10K 9/122; G10K 9/121
See application file for complete search history.

(56) References Cited

U.S. PATENT DOCUMENTS

| | | | | |
|---|---|---|---|---|
| 6,163,613 | A | 12/2000 | Cowans | |
| 7,747,029 | B2 | 6/2010 | Kim | |
| 8,447,054 | B2 * | 5/2013 | Bharatan | H04R 1/28 381/174 |
| 8,861,752 | B2 | 10/2014 | Margalit | |
| 9,637,374 | B2 | 5/2017 | Jenkins | |
| 9,843,862 | B2 | 12/2017 | Barzen | |
| 2002/0076139 | A1 | 6/2002 | Kobrin | |
| 2003/0215972 | A1 | 11/2003 | Zou | |
| 2007/0237338 | A1 | 10/2007 | Konchitsky | |
| 2009/0124035 | A1 | 5/2009 | Rey | |
| 2010/0098271 | A1 * | 4/2010 | Mundorf | H04R 1/323 381/162 |
| 2011/0140216 | A1 | 6/2011 | Qu | |
| 2012/0018244 | A1 | 1/2012 | Robert | |
| 2012/0308046 | A1 | 12/2012 | Muza | |
| 2013/0044904 | A1 | 2/2013 | Margalit | |
| 2013/0129121 | A1 * | 5/2013 | Yamashita | H04R 19/02 381/191 |
| 2014/0169585 | A1 * | 6/2014 | Howes | H04R 1/086 381/91 |
| 2014/0247955 | A1 * | 9/2014 | Nystrom | H04R 19/02 381/150 |
| 2015/0208175 | A1 | 7/2015 | Pinkerton | |
| 2015/0281847 | A1 * | 10/2015 | Backman | H04R 19/02 381/423 |
| 2016/0381464 | A1 | 12/2016 | Elyada | |
| 2017/0026726 | A1 | 1/2017 | Kim | |
| 2017/0201192 | A1 | 7/2017 | Tumpold | |
| 2017/0280218 | A1 | 9/2017 | Wang | |
| 2018/0179048 | A1 | 6/2018 | Schenk | |
| 2018/0206042 | A1 | 7/2018 | Kursula | |

OTHER PUBLICATIONS

Liang, Title of Invention: Sound Producing Device , U.S. Appl. No. 16/125,761, filed Sep. 9, 2018.

John J. Neumann Jr. et al., CMOS-MEMS membrane for audio-frequency acoustic actuation, Sensors and Actuators A 95, 2002, pp. 175-182, Elsevier, USA, XP004377889.

* cited by examiner

AIR PULSE GENERATING ELEMENT AND MANUFACTURING METHOD THEREOF

CROSS REFERENCE TO RELATED APPLICATIONS

This application claims the benefit of U.S. provisional application No. 62/574,089, filed on Oct. 18, 2017, U.S. provisional application No. 62/652,908, filed on Apr. 5, 2018, U.S. provisional application No. 62/719,694, filed on Aug. 19, 2018 and U.S. provisional application No. 62/722,085, filed on Aug. 23, 2018, which are all incorporated herein by reference.

BACKGROUND OF THE INVENTION

1. Field of the Invention

The present invention relates to an air pulse generating element and manufacturing method thereof, and more particularly, to an air pulse generating element and manufacturing method capable of producing high fidelity sound.

2. Description of the Prior Art

Speaker driver is always the most difficult challenge for high-fidelity sound reproduction in the speaker industry. The physics of sound wave propagation teaches that, within the human audible frequency range, the sound pressures generated by accelerating a membrane of a conventional speaker driver may be expressed as $P \propto S \cdot A$ (eq-1), where S is the membrane surface area and A is the acceleration of the membrane. Namely, the sound pressure P is proportional to the product of the membrane surface area S and the acceleration of the membrane A. In addition, the membrane displacement D may be expressed as $D \propto \frac{1}{2} \cdot A \cdot T^2 \propto 1/f2$ (eq-2), where T and f are the period and the frequency of the sound wave respectively. The air volume movement $V_{A,CV}$ caused by the conventional speaker driver may then be expressed as $V_{A,CV} \propto S \cdot D$. For a specific speaker driver, where the membrane surface area is constant, the air movement $V_{A,CV}$ is proportional to $1/f^2$, i.e., $V_{A,CV} \propto 1/f^2$ (eq-3).

In order to produce enough sound pressure P of the speaker driver, either the acceleration of the membrane A or the membrane displacement D of the speaker driver should be increased. However, the membrane displacement D of the conventional speaker driver is restricted to a peak displacement of the membrane, which confines the sound pressure P of the conventional speaker driver.

Therefore, how to provide an air pulse generating element to overcome the design challenges faced by conventional speakers as stated above is an important objective in the field.

SUMMARY OF THE INVENTION

It is therefore a primary objective of the present invention to provide air pulse generating element and manufacturing method capable of producing high fidelity sound and enough sound pressure.

An embodiment of the present invention discloses an air pulse generating element, comprising a front faceplate; a back faceplate; a front supporting element, connected to the front faceplate; a back supporting element, connected to the back faceplate; a folded membrane, configured to form a front chamber and a back chamber, and comprising a plurality of membrane units; wherein the plurality of membrane units are parallel and sequentially connected and an end of the folded membrane is connected to the back faceplate via the back supporting element and another end of the folded membrane is connected to the front faceplate via the front supporting element; and a plurality of valves controlling a plurality of air flow channels between the front chamber toward either a front space or aback space, and between the back chamber toward either the front space or the back space; wherein the plurality of membrane units are configured to perform horizontal deformation to squeeze air in and out of the front or back chamber with operations of the plurality of valves controlling the direction of the air pulse toward the front space or the back space.

In an embodiment, a plurality of actuators, each formed on a side of a membrane unit of the plurality of membrane units.

In an embodiment, the plurality of actuators are mounted on a plurality of membrane units, such that the plurality of membrane units flexibly perform the horizontal deformation.

In an embodiment, the first front valve is controlled by a first front valve-controlling signal to control an airflow through the back faceplate; the first back valve, controlled by a first back valve-controlling signal to control the airflow through the back faceplate; the second front valve, controlled by a second front valve-controlling signal to control the airflow through the front faceplate; and the second back valve, controlled by a second back valve-controlling signal to control the airflow through the back faceplate.

In an embodiment, the first front valve-controlling signal equals the second back valve-controlling signal, and the first back valve-controlling signal equals the second front valve-controlling signal.

In an embodiment, the plurality of actuators are electrostatic actuators with a plurality of electrodes, such that the plurality of membrane units perform the horizontal deformation when a plurality of driving charges are applied on the plurality of electrodes.

In an embodiment, when the plurality of actuators are piezoelectric actuators with a plurality of electrodes, the plurality of membrane units perform the horizontal deformation when a plurality of driving charges are applied on the plurality of electrodes.

In an embodiment, when the folded membrane is incorporated with electromagnetic actuator and a current flows along the folded membrane, the plurality of membrane units perform the horizontal deformation.

In an embodiment, the air pulse generating element receives an input audio signal, and an amplitude and a polarity of each air pulse generated by the air pulse generating element are related to a amplitude and a polarity of a time-sample of the input audio signal.

In an embodiment, a driving voltage is applied to each of a plurality of actuators of the air pulse generating element, such that the air pulse generating element generates a plurality of air pulses in response to the driving voltage; a plurality of air pulses are at a pulse rate, and the pulse rate of the plurality of air pulses is higher than a maximum audible frequency.

In an embodiment, the pulse rate of the plurality of air pulses is at least twice higher than a maximum frequency of an input audio signal to be reproduced.

In an embodiment, the pulse rate of the plurality of air pulses is at least twice higher than a maximum audible frequency.

In an embodiment, a direction of an air mass velocity within a pulse cycle is in a front-to-back direction or a back-to-front direction regardless an initial position of the folded membrane, and a plurality of valve-controlling signals are generated to the plurality of valves to perform an open-and-close movement.

In an embodiment, the horizontal deformation performed by the plurality of membrane units and the open-and-close movement performed by the plurality of valves are mutually synchronized.

Another embodiment of the present invention discloses a manufacturing method for a folded membrane of an air pulse generating element, comprising depositing a substrate; performing a reactive-ion etching (RIE) or a deep reactive-ion etching (DRIE) on the substrate with a folded pattern; depositing a first dielectric layer on the substrate; depositing a conductive layer on the first dielectric layer; depositing a second dielectric layer on the conductive layer; and etching the substrate to form a folded membrane.

Another embodiment of the present invention discloses a manufacturing method for a folded membrane of an air pulse generating element, comprising forming a plurality of trenches on a patterned substrate; performing an isotropic etching to undercut a bottom of the plurality of trenches and forming a plurality of connection units; coating the plurality of trenches with a polymer film; and removing the patterned substrate to form a folded membrane.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
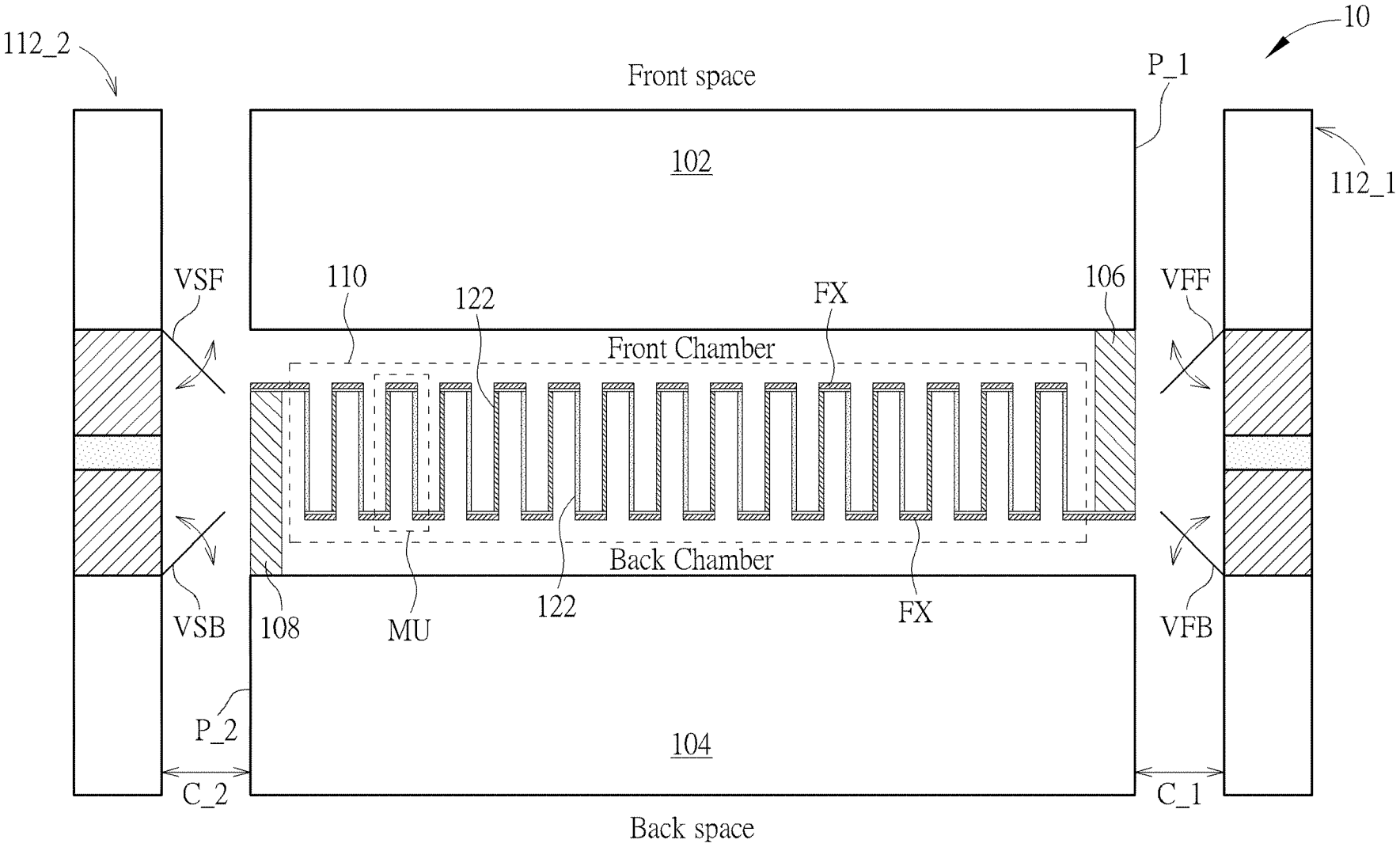
FIG. 1A is a schematic diagram of a cross-sectional view of an air pulse generating element according to an embodiment of the present invention.

Please refer to FIG. 1A, which is a schematic diagram of a cross-sectional view of an air pulse generating element 10 according to an embodiment of the present invention. The air pulse generating element 10 may be a MEMS (micro-electrical-mechanical-system) device, which includes a front faceplate 102, a back faceplate 104, a front supporting element 106, a back supporting element 108, a folded membrane 110, a first wall 112_1, a second wall 112_2, a first front valve VFF, a first back valve VFB, a second front valve VSF and a second back valve VSB. The folded membrane 110 is a thin membrane made of single crystal Silicon, poly-silicon, Mylar, dry film, Benzocyclobutene (BCB), Parylene(Poly-p-xylene) for non-conductive type polymer; Polydimethylsiloxane (PDMS), Poly-3,4-Ethylenedioxythiophene (PEDOT), polyaniline (PANI), Polythiophenes (PTs), poly(p-phenylene sulfide) (PPS), poly(p-phenylene vinylene) (PPV) and Poly(acetylene) (PAC) for conductive type polymer. The folded membrane 110 is configured to form a front chamber and a back chamber with the front faceplate 102 and the back faceplate 104, and consisted of a plurality of membrane units MU. The membrane units MU are parallel and sequentially connected. In addition, an end of the folded membrane 110 is connected to the back faceplate 104 via the back supporting element 108 and another end of the folded membrane 110 is connected to the front faceplate 102 via the front supporting element 106. The first wall 112_1 is disposed along a first plane P_1 corresponding to a side of the front supporting element 106 with a first channel C_1, the first front valve VFF and the first back valve VFB are connected to the front or back space at the first wall 112_1 and extended from the first wall 112_1 toward the front supporting element 106. On the opposite side of the front supporting element 106, the second wall 112_2 is disposed along a second plane P_2 corresponding to a side of the back supporting element 108 with a second channel C_2, and the second front valve VSF and the second back valve VSB are connected to the front or back space at the second wall 112_2 and extended from the second wall 112_2 toward the back supporting element 108.

In the embodiment illustrated in FIG. 1A, the membrane units MU are mounted on a plurality of fixing elements FX, such that the membrane units MU may flexibly perform the horizontal deformation. More specifically, the fixing elements FX fix the folded membrane 110 at both ends of each of the membrane units MU, such that each the membrane units MU may perform the horizontal deformation driven by actuators 122 deposited on the membrane units MU. The horizontal deformation of membrane units MU increase or decrease the pressure at front or back chamber, respectively. The pressure change causes air movement of squeeze out or suck from these chambers into front or back space through the open and close movement of valves. Specifically, the top surface of the membrane units MU of the folded membrane 110 is connected to front chamber. If it is configured to perform a horizontal deformation to reduce the volume of the front chamber, air movement will flow toward the front space if the second front valve VSF is opened and the second back valve VSB is closed or toward the back space if the second front valve VSF is closed and the second back valve VSB is opened. At the moment, the horizontal deformation of the folded membrane 110 increases the volume of the back chamber, and cause sucking in air from the front space if the first front valve VFF is opened and the first back valve VFB is closed, or from the back space if the first front valve VFF is closed and the first back valve VFB is opened. The horizontal deformation of the folded membrane 110 is designed to increase or decrease the volume of front or back chamber and is controlled by a membrane-controlling signal which is connected to the actuators 122 of the folded membrane 110, such that air in the front chamber and back chamber of the air pulse generating element 10 is squeezed in and out to produce a sound pressure level.

In addition, the first front valve VFF is controlled by a first front valve-controlling signal to control an airflow through the front faceplate 102, the first back valve VFB is controlled by a first back valve-controlling signal to control the airflow through the back faceplate 104, the second front valve VSF is controlled by a second front valve-controlling signal to control the airflow through the front faceplate 102, and the second back valve VSB is controlled by a second back valve-controlling signal to control the airflow through the back faceplate 104.

Regarding operations of the valves VFF, VFB, VSF and VSB, the first front valve-controlling signal might be equal to the second back valve-controlling signal, and the first back valve-controlling signal might be equals to the second front valve-controlling signal. In other words, the first front and second back valve-controlling signals respectively control the first front valve VFF and the second back valve VSB to open or close at the same time for some embodiments, and the first back and second front valve-controlling signals respectively control the first back valve VFF and the second front valve VSB to open or close at the same time for some embodiments. In this way, the valves VFF, VFB, VSF and VSB are controlled to open and close to enable the horizontal deformation of the membrane units MU, squeeze the air into the front chamber or back chamber of the air pulse generating element 10 and produce the sound pressure level. Therefore, the horizontal deformation performed by the membrane units MU and the open-and-close movement performed by the valves are mutually synchronized.

Figure 1B:
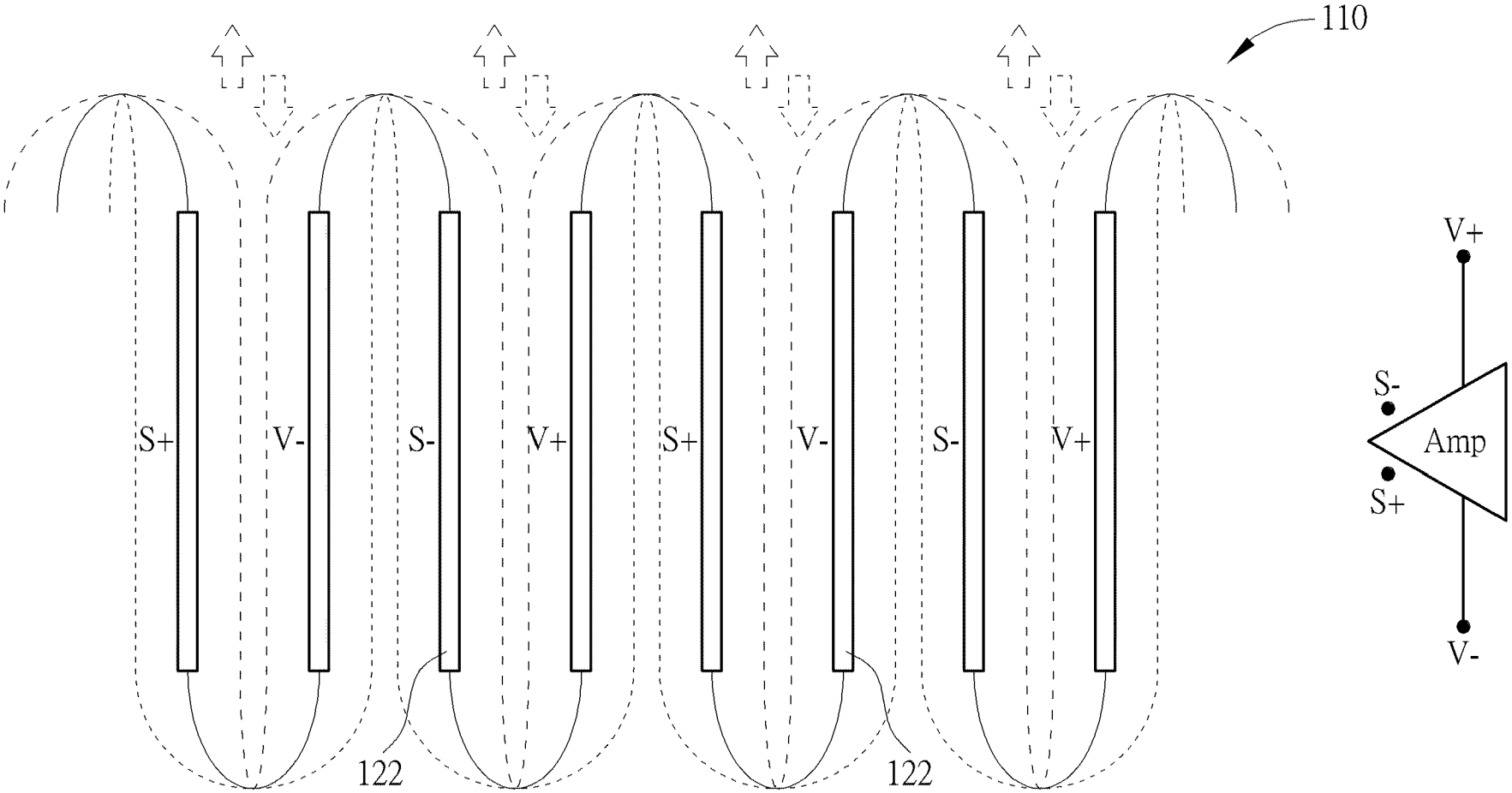
FIG. 1B is a schematic diagram of a folded membrane according to an embodiment of the present invention.

The air pulse generating element 10 further comprises a plurality of actuators 122 on each of the membrane units MU. As can be seen in FIG. 1B, the actuators 122 are respectively formed on or attached to both sides of the membrane units MU. In an embodiment, when the actuators 122 are electrostatic actuator with flat electrodes and electrically conducted, the membrane units MU may perform the horizontal deformation with a plurality of driving charges applied on the electrodes. For example, the electrodes may be attached or formed on an underlying flexible film by printing or depositing stripes of conductive patterns on a Mylar film. In an embodiment, the electrodes may be respectively connected to a power amplifier, which provides voltages V+, V− and bias signals S+, S−, wherein the voltages V+, V− may be bias voltages for the power amplifier and the bias signals S+, S− may be differential output signals of the power amplifier.

Figure 2:
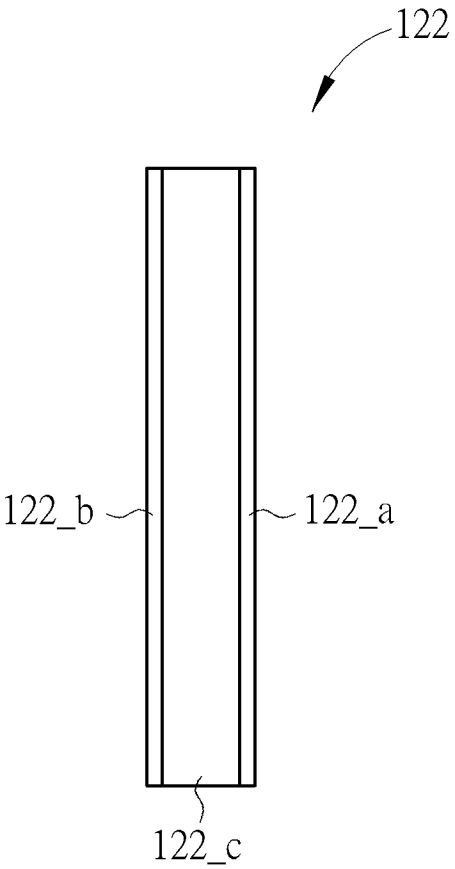
FIG. 2 is a schematic diagram of a cross-sectional view of an actuator according to an embodiment of the present invention.

Please refer to FIG. 2, which is a schematic diagram of a cross-sectional view of the actuator 122 according to an embodiment of the piezoelectric actuators. The actuator 122 may comprise a piezoelectric layer 122_*c* sandwiched between two electrodes 122_*a* and 122_*b*. The bias signals S+ or S− may be applied on the electrode 122_*a* and the electrode 122_*b*. The piezoelectric layer 122_*c* may, but not limited to, be made of PZT (lead zirconate titanate) or AlScN (scandium doped aluminum nitride). The electrodes 122_*a* is made of platinum (Pt) for some embodiments, deposited onto a side facing the membrane unit MU and served as the bias electrode, and the electrodes 122_*c* is made of gold (Au) for some embodiments, deposited onto a side facing the air and served as the driving electrode.

Figure 3:
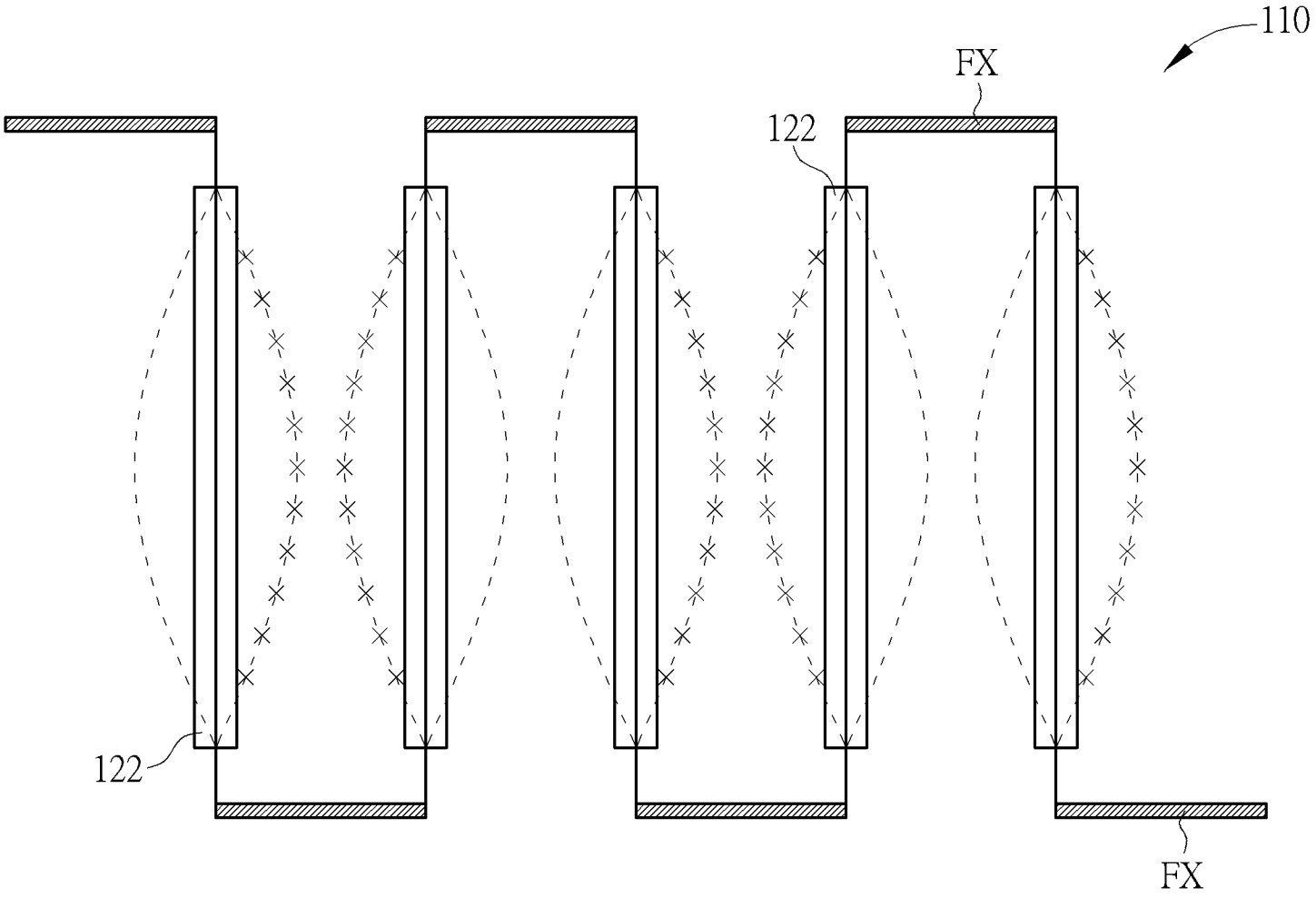
FIG. 3 is a schematic diagram of the actuators with piezoelectric electrode formed on the folded membrane according to an embodiment of the present invention.

In an embodiment, please refer to FIG. 3, which is a schematic diagram of the actuators 112 with piezoelectric films and electrodes formed on the vertical sidewall of folded membrane 110 according to an embodiment of the present invention. In the embodiment, the membrane units MU may bend to two directions so as to perform the horizontal deformation. More specifically, when all bias electrodes (i.e. electrode 122_*a* of each of the membrane units MU) are connected to $V_{bias}$, a connection order for the driving electrodes corresponding to the membrane units MU respectively in FIG. 3 is [S−, S+], [S+, S−], [S−, S+], [S+, S−] . . . . Dot lines and cross lines in FIG. 3 illustrate positions of the membrane units MU when the dual polarity driving signals S+ and S− reach the peak and valley of the driving signal, which correspond to a peak displacement of the membrane units MU. Therefore, with the displacement of the membrane units MU, the air will be moved in and out of the front chamber and the back chamber, and thus produce sound pressure level and sound wave. Notably, the connection order for the driving electrodes corresponding to the membrane units MU respectively in FIG. 3 may also be [S+, S−], [S−, S+], [S+, S−], [S−, S+] . . . .

Figure 4:
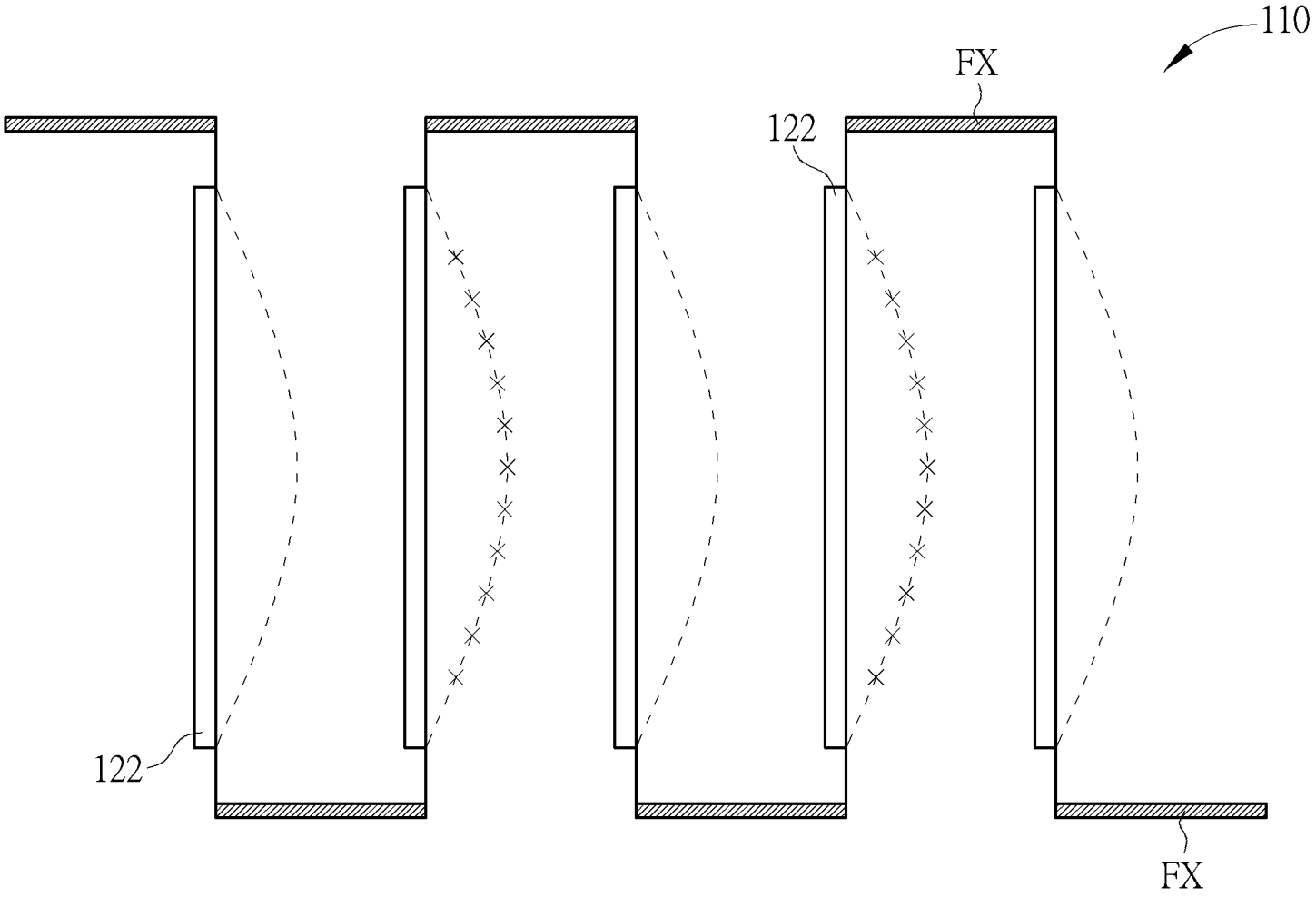
FIG. 4 is a schematic diagram of the actuators with the piezoelectric electrodes formed on the folded membrane according to another embodiment of the present invention.

In another embodiment, please refer to FIG. 4, which is a schematic diagram of the actuators 122 with the piezoelectric electrodes formed on the folded membrane 110 according to another embodiment of the present invention. In FIG. 4, the actuators 122 are respectively formed on or attached to one side of the membrane units MU. In this way, the membrane units MU may bend to one direction so as to perform the horizontal deformation. More specifically, when all bias electrodes (i.e. electrode 122_*a* of each of the membrane units MU) are connected to $V_{bias}$, a connection order for the driving electrodes corresponding to the membrane units MU respectively in FIG. 4 is S+, S−, S+, S− . . . . Dot lines and cross lines in FIG. 4 illustrate positions of the membrane units MU when the dual polarity driving signals S+ and S− reach the peak and valley of the driving signal, which correspond to the peak displacement of the membrane units MU. Therefore, with the displacement of the membrane units MU, the air in the chamber will be moved in and out of the air pulse generating element 10, and thus produce sound pressure level and sound wave.

Figure 5A:
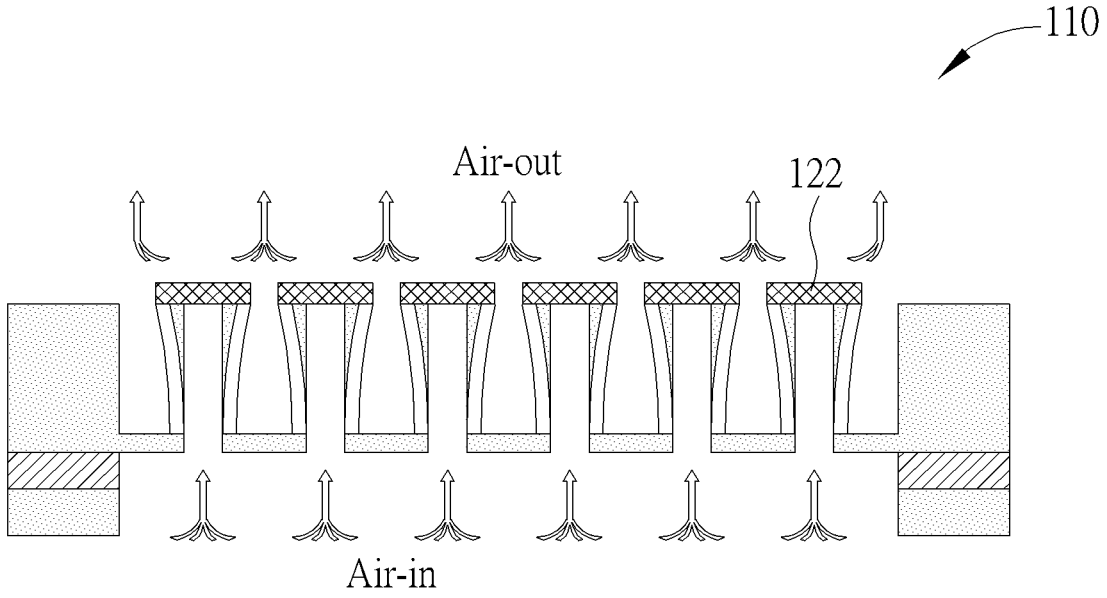
FIG. 5A is a schematic diagram of air-out phase when 1-layer piezoelectric actuators are formed on the folded membrane according to an embodiment of the present invention.
Figure 5B:
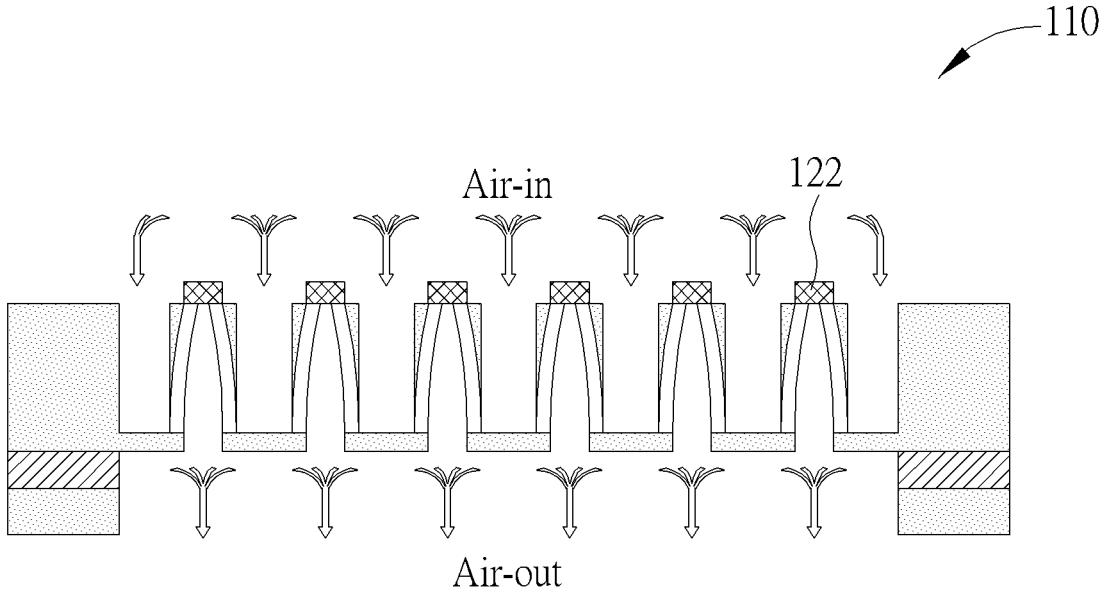
FIG. 5B is a schematic diagram of air-in phase when 1-layer piezoelectric actuators are formed on the folded membrane according to an embodiment of the present invention.

In an embodiment, please refer to FIGS. 5A, 5B, 6A and 6B, the 1-layer and the 2-layer piezoelectric actuators 122 are placed on the horizontal surfaces of the folded membrane. FIGS. 5A and 5B respectively illustrate air-out phase and air-in phase when the 1-layer piezoelectric actuators 122 are formed on the folded membrane 110. More specifically, the actuators 122 are formed on a top surface of the folded membrane 110. Therefore, when the driving signals S+, S− are applied on the actuators 122, the actuators 122 expand horizontally due to piezoelectric effect and deform the folded membrane 110 and squeeze out or suck the air.

Figure 6A:
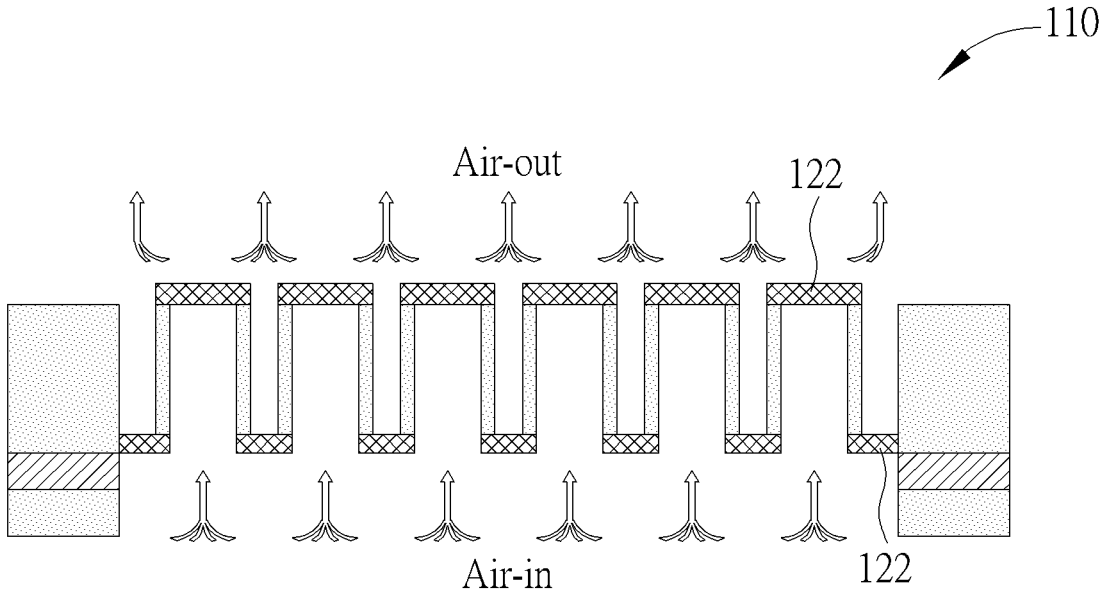
FIG. 6A is a schematic diagram of air-out phase when 2-layer piezoelectric actuators are formed on the folded membrane according to an embodiment of the present invention.
Figure 6B:
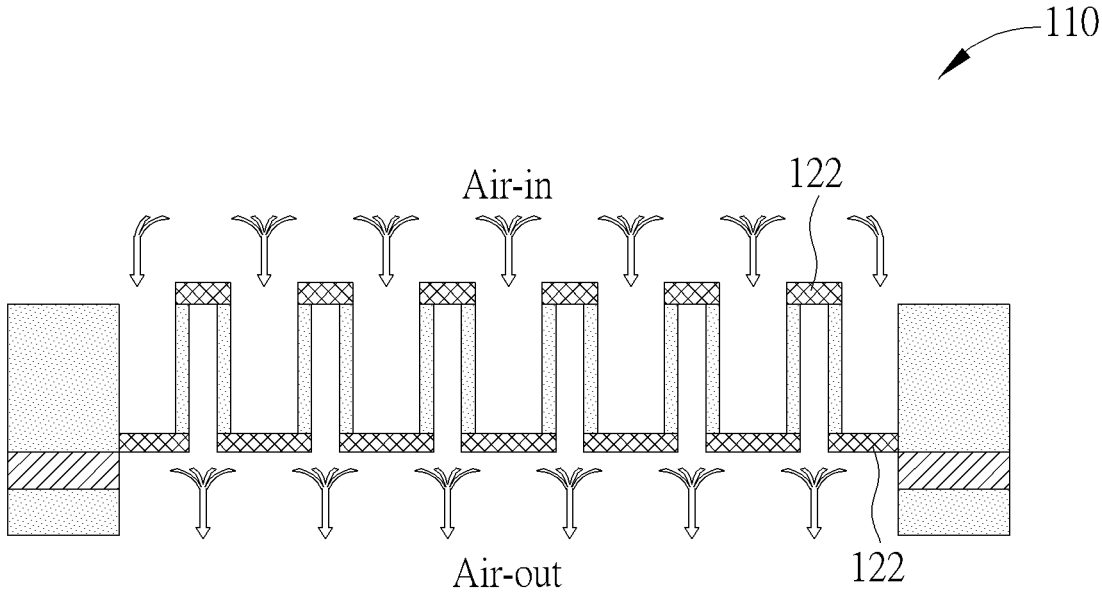
FIG. 6B is a schematic diagram of air-in phase when 2-layer piezoelectric actuators are formed on the folded membrane according to an embodiment of the present invention.

FIGS. 6A and 6B respectively illustrate the air-out phase and the air-in phase when the 2-layer piezoelectric actuators 122 are formed on the folded membrane 110. More specifically, the 2-layer piezoelectric actuators are deposited on both top and bottom sides of the folded membrane 110 to create a more symmetric and larger horizontal deformation compared with FIGS. 5A and 5B. Therefore, when the driving signals S+, S− are applied on the actuators 122, the actuators 122 deform the folded membrane 110 and squeeze out or suck the air. Notably, the piezoelectric material may be implemented by PZT, ZnO, AlN or AlScN. In another embodiment, other types of the actuators 122, such as, electro-thermal type, may be incorporated thereto.

The air pulse generating element 10 may generate a series of air pulses at a pulse rate, as shown in FIGS. 7-10, where the pulse rate is significantly higher than the maximum human audible frequency. The pulse rate may be an ultrasonic rate, e.g., 64 KHz, significantly higher than twice of the maximum human audible frequency, which is generally considered to be 20K Hz. This pulse rate is determined based on Nyquist law, which states, in order to avoid frequency spectral aliasing, the pulse rate needs to be at least twice higher than the maximum frequency of the input audio signal. The series/plurality of air pulses generated by the air pulse generating element 10 may be referred as an ultrasonic pulse array (UPA). In an embodiment, the pulse rate may be an ultrasonic rate, e.g., 64 KHz, significantly higher than twice of the maximum human audible frequency, which is generally considered to be 20K Hz. This pulse rate is determined based on Nyquist law, which states, in order to avoid frequency spectral aliasing, the pulse rate needs to be at least twice higher than the maximum frequency of the input audio signal. The series/plurality of air pulses generated by the air pulse generating element 10 may be referred as an ultrasonic pulse array (UPA).

Figure 11:
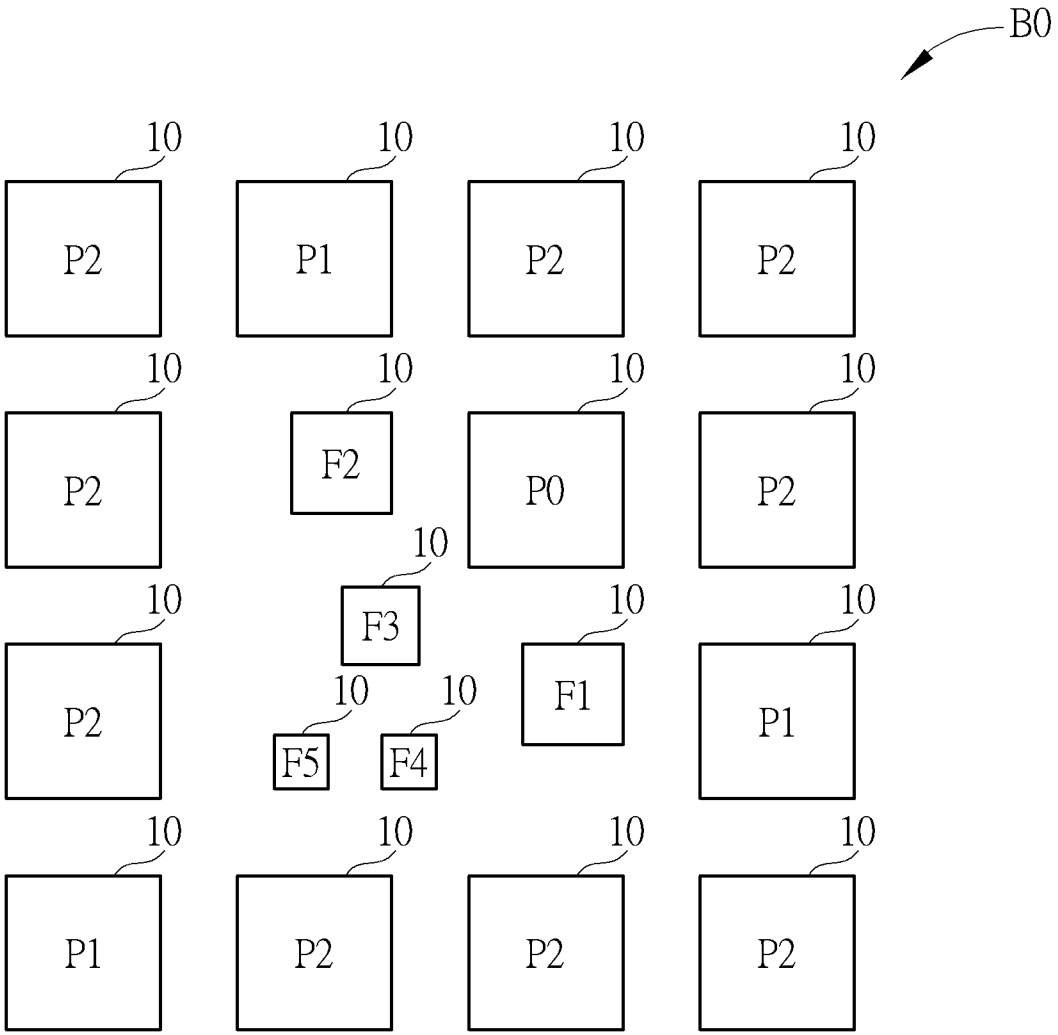
FIG. 11 is a schematic diagram of a sound producing device according to an embodiment of the present invention.

In the embodiment illustrated in FIG. 11, multiple air pulse generating elements 10 are grouped into air pulse generating groups labeled as P0, P1, P2, and F1-F5 as a sound producing device BO. The air pulse generating group P2 includes 9 air pulse generating elements 10, the air pulse generating group P1 includes 3 air pulse generating elements 10, and the air pulse generating groups P0 and F1-F5 includes 1 air pulse generating element 10, respectively. Details of the sound producing device BO may be referred to U.S. application Ser. No. 16/125,761, which is not narrated herein for brevity.

Figure 7:
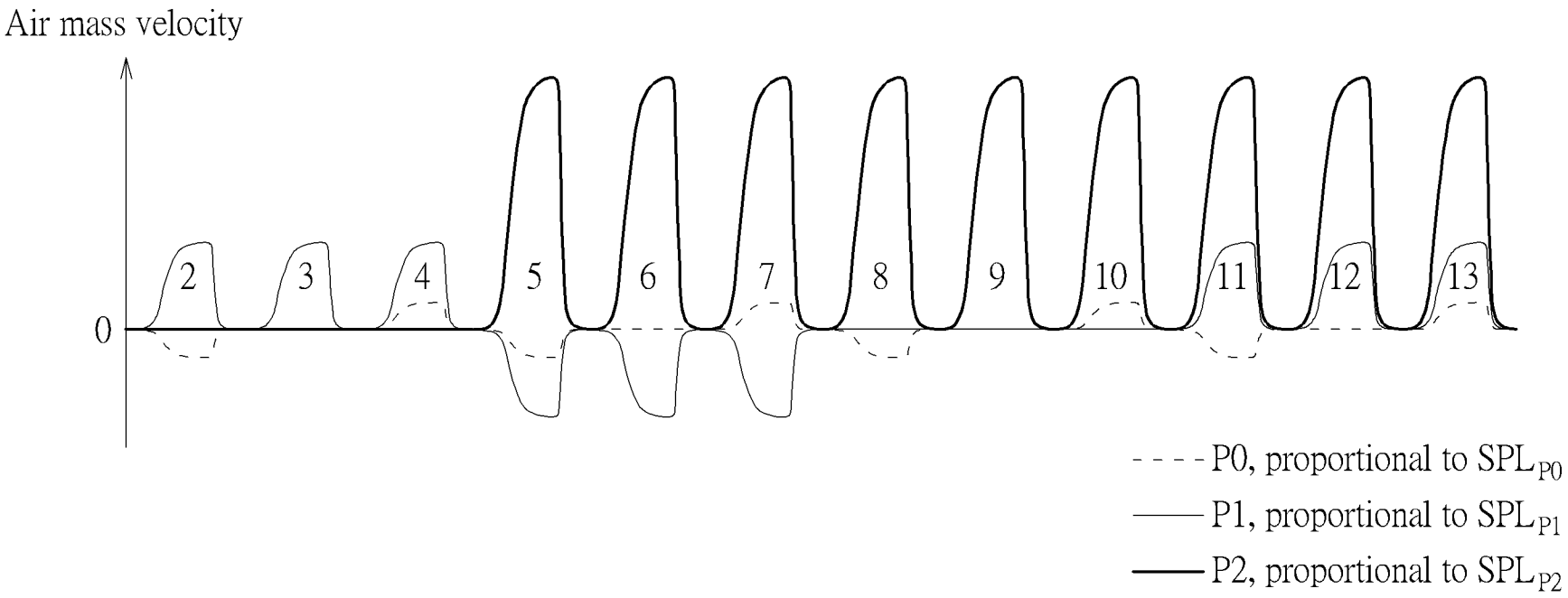
FIG. 7 is a schematic diagram of an air mass velocity according to an embodiment of the present invention.

In addition, please refer to FIG. 7, the air-flow speed, i.e., the air mass velocity, with respect to time produced by the air pulse generating groups P0, P1 and P2 over 12 consecutive air pulse cycles are shown. The amplitudes of SPL corresponding to the three air pulse generating groups P0, P1 and P2, denoted as $SPL_{P0}$, $SPL_{P1}$ and $SPL_{P2}$, have a ratio relationship of $SPL_{P0}:SPL_{P1}:SPL_{P2}=1:3:9$ in between. The "0" state representing "Speed=0" is omitted for brevity. Each air pulse generating group may arbitrarily generate a positive pulse (corresponding to the "+1" state), a negative pulse (corresponding to the "−1" state), or a null pulse (corresponding to the "0" state) within a certain pulse cycle PC, regardless of the polarity of previous air pulse. As FIG. 7 shows, the air pulse generating group P2 starts with 3 null pulses, and finishes with 9 consecutives positive pulses; the air pulse generating group P1 starts with 3 positive pulses, followed by 3 negative pulses and 3 null pulses, and finishes with 3 positive pulses; and the air pulse generating group P0 repeatedly generates a negative pulse, a null pulse and a positive pulse, in 4 iterations. Therefore, the resulting aggregated SPLs generated by the air pulse generating elements 10, including the air pulse generating groups P0, P1 and P2, over the consecutive 12 cycles has a ratio of 2:3:4:5:6:7:8:9:10:11:12:13, as shown in scalar form in FIG. 7. In this regard, the UPA, i.e., the series/plurality of air pulses generated by the air pulse generating elements 10 may be amplitude modulated. Note that, the SPL is a first-order derivative of air mass velocity with respect to time.

Similarly, the air pulse generating groups F1-F5 may be designed such that the amplitude of SPL generated by the air pulse generating group Fy (or the air pulse generating element within the air pulse generating group Fy) is $1/3^y$ of the $SPL_{P0}$, where y may be 1, . . . , 5. The fractional air pulse generating elements (i.e., the air pulse generating elements of the air pulse generating groups F1-F5) may be accomplished either by shrinking the geometry of the full cell (i.e., the air pulse generating element of the air pulse generating group P0), or by reducing the piezoelectric to membrane coverage ratio.

Figure 8:
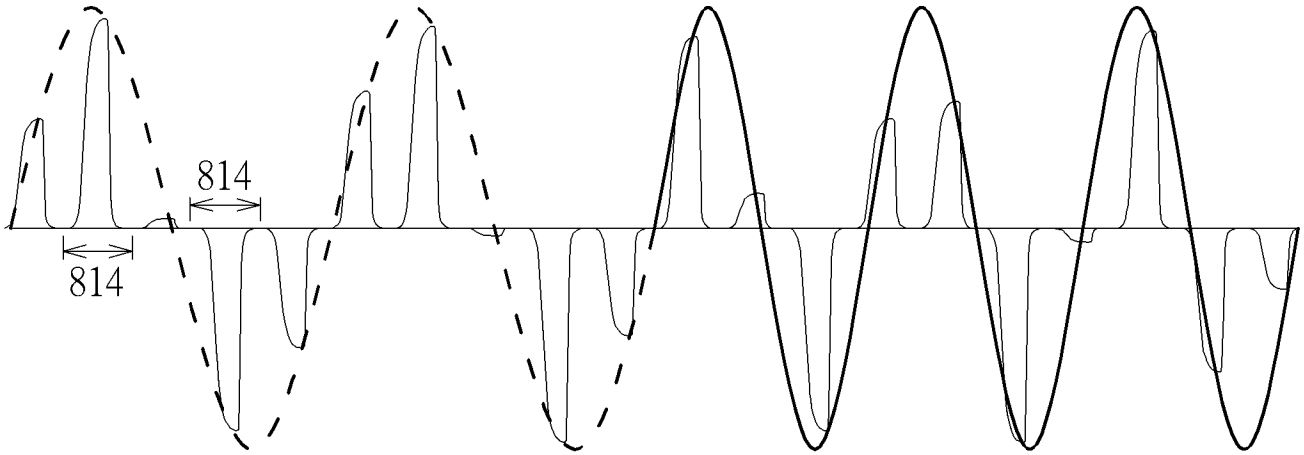
FIG. 8 is a schematic diagram of an air mass velocity according to an embodiment of the present invention.
Figure 9:
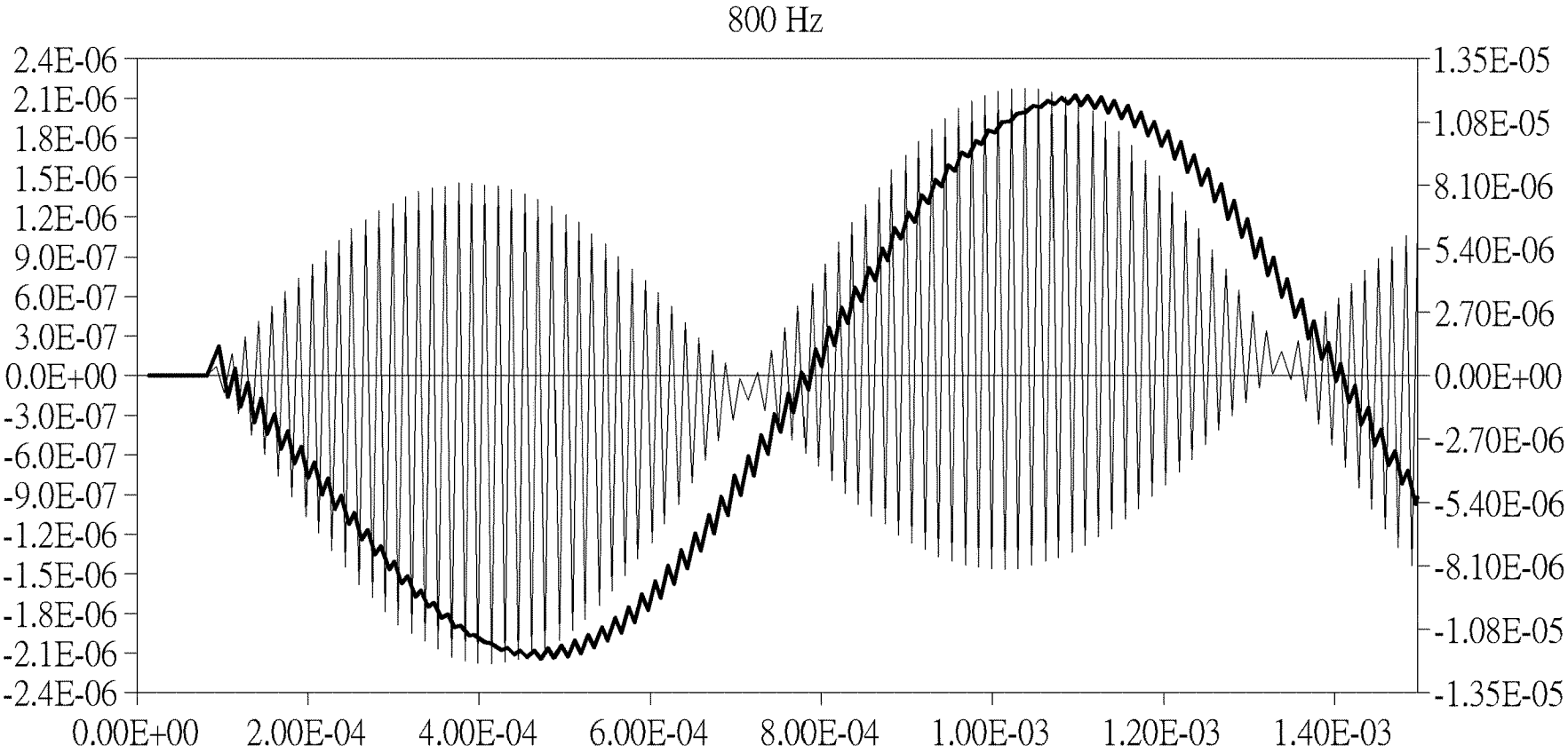
FIG. 9 is a schematic diagram of a sound pressure level (SPL) according to an embodiment of the present invention.
Figure 10:
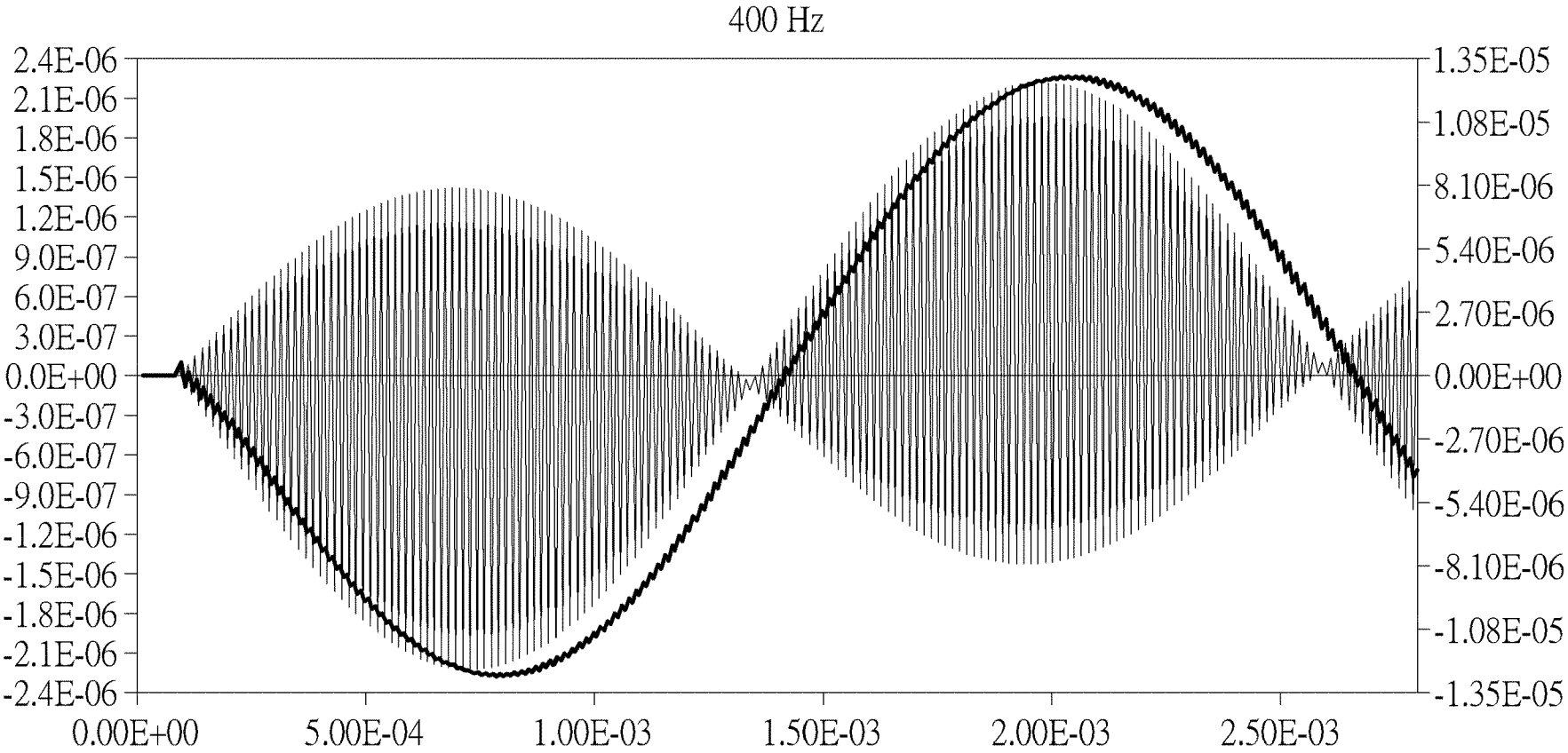
FIG. 10 is a schematic diagram of the SPL according to an embodiment of the present invention.

Refer to FIG. 8, a pulse array or a series/plurality of air pulses generated by the air pulse generating elements 10 according to a sinusoidal sound wave is illustrated. A plurality of air pulses, shown in solid line, is generated over a plurality of fixed cycles 814. An amplitude and a polarity of each pulse are related to an amplitude and a polarity of a sample of the sinusoidal sound wave. In other words, the plurality of air pulses generated by the air pulse generating elements 10 is regarded as being amplitude-modulated (AM) according to the sinusoidal sound wave. Similarly, the plurality of air pulses generated by the air pulse generating elements 10 may be amplitude-modulated according to an input audio signal, which means that an amplitude and a polarity of each pulse are related to an amplitude and a polarity of a time-sample of the input audio signal, wherein the time-sample of the input audio signal represents an instantaneous value of the input audio signal sampled at a sampling time instant.

Figure 12:
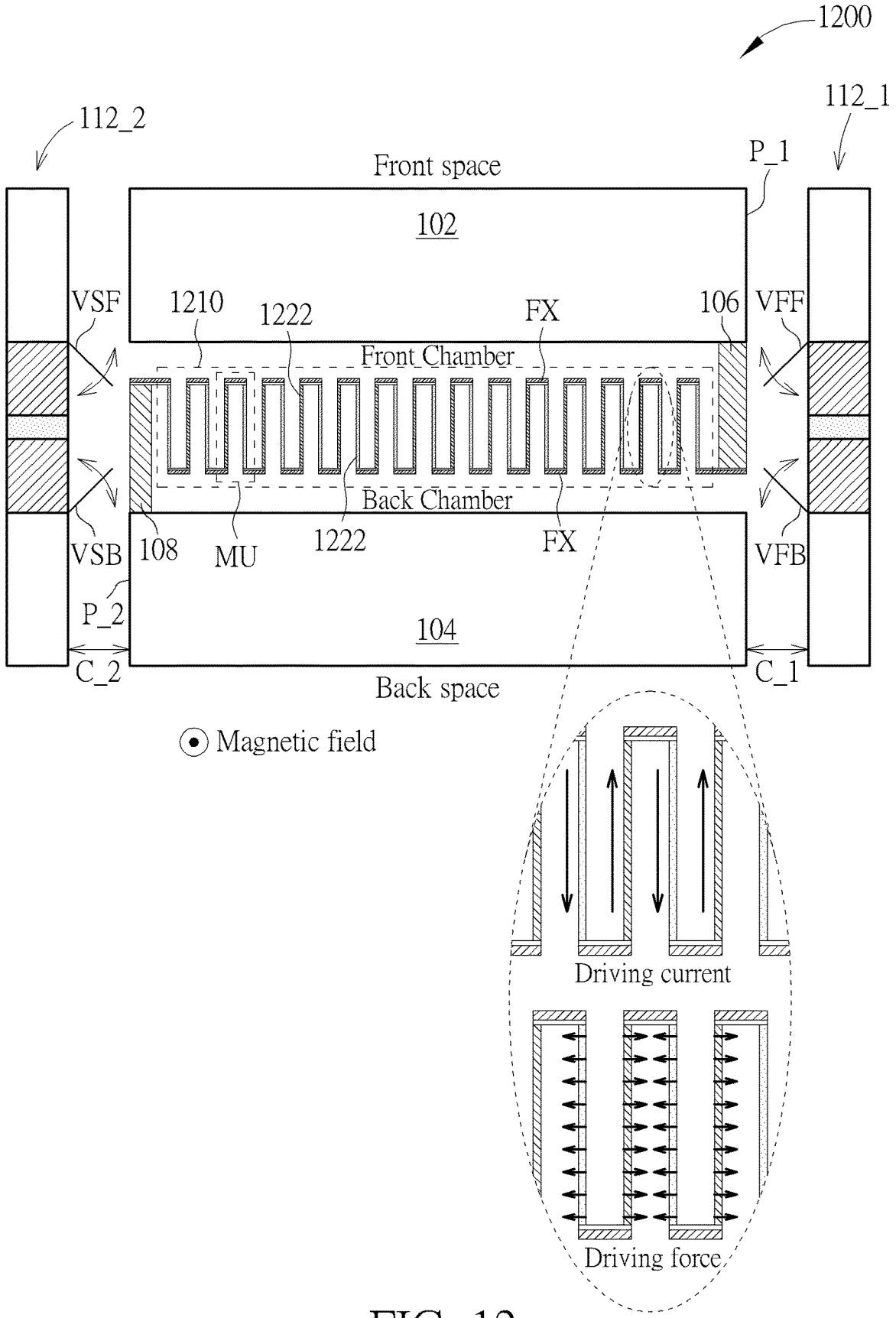
FIG. 12 is a schematic diagram of a cross-sectional view of an air pulse generating element according to another embodiment of the present invention.

According to different applications or concepts, the air pulse generating element 10 may be implemented by all kinds of methods. Please refer to FIG. 12, which is a schematic diagram of a cross-sectional view of an air pulse generating element 1200 according to another embodiment of the present invention with electromagnetic actuators. Different with the air pulse generating element 10, a folded membrane 1210 of the air pulse generating element 1200 is incorporated with electromagnetic actuators 1222, and the else elements with the same function share the same notion with FIG. 1. In FIG. 12, when a driving current flows along the folded membrane 1210, under an influence of external magnetic field, the membrane units MU is configured to perform the horizontal deformation corresponding to a driving force of the Lorentz effect generated by an interaction of the magnetic field and the driving current flow. The horizontal deformation of folded membrane 1210 causes the air in the chamber to be moved in and out of the front chamber and the back chamber, and thus, the air pulse generating element 1200 produce sound pressure level and sound wave.

Figure 13:
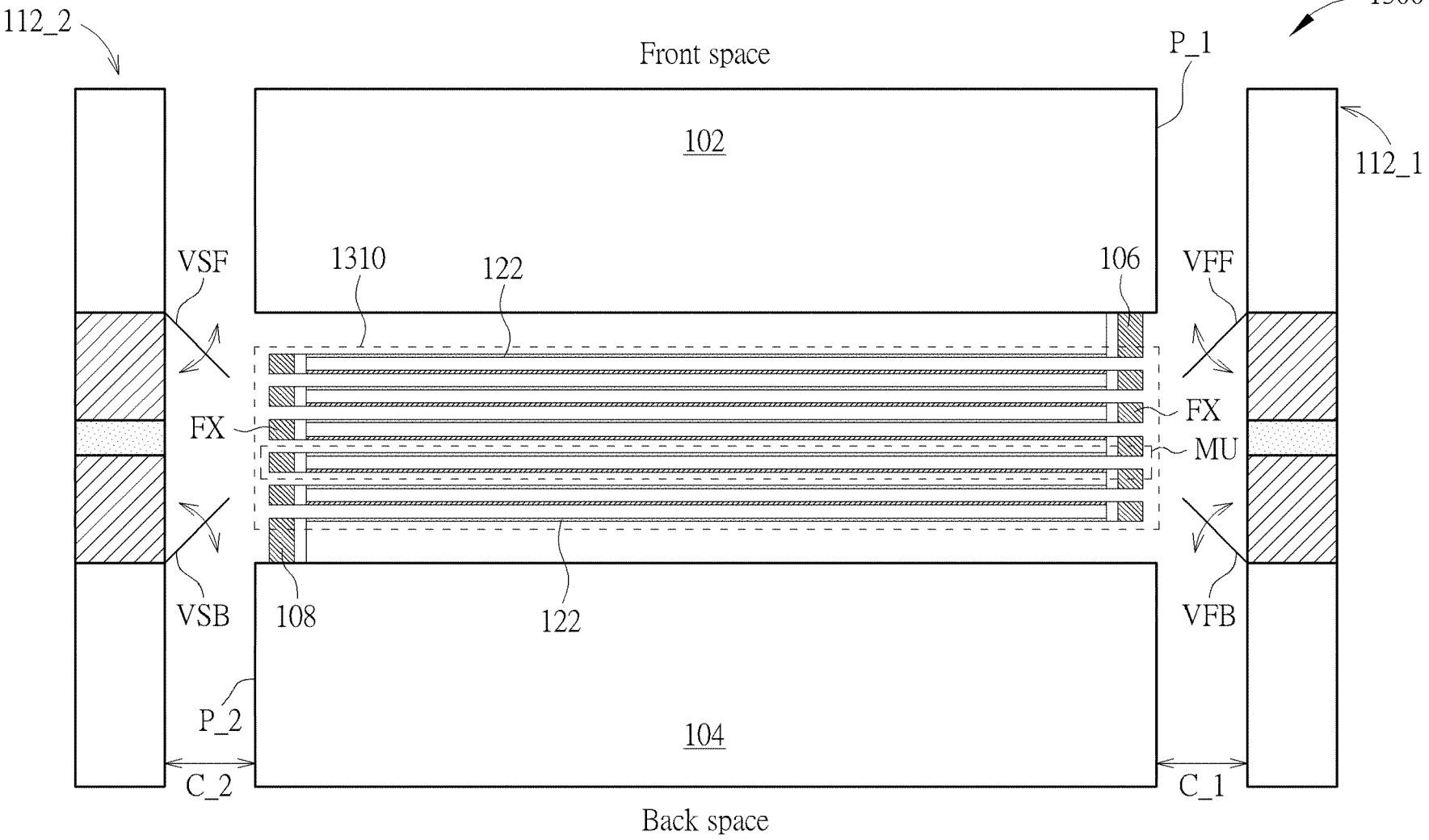
FIG. 13 is a cross-sectional view of an air pulse generating element according to another embodiment of the present invention.

In addition, in another example, the folded membrane 110 is not limited to the structure illustrated in FIG. 1. Please refer to FIG. 13, which is a cross-sectional view of an air pulse generating element 1300 according to another embodiment of the present invention. In order to increase a membrane area, the folded membrane 1310 may be disposed horizontally, and likewise deform vertically in one or two directions, to produce sound pressure level and sound wave.

Figure 14:
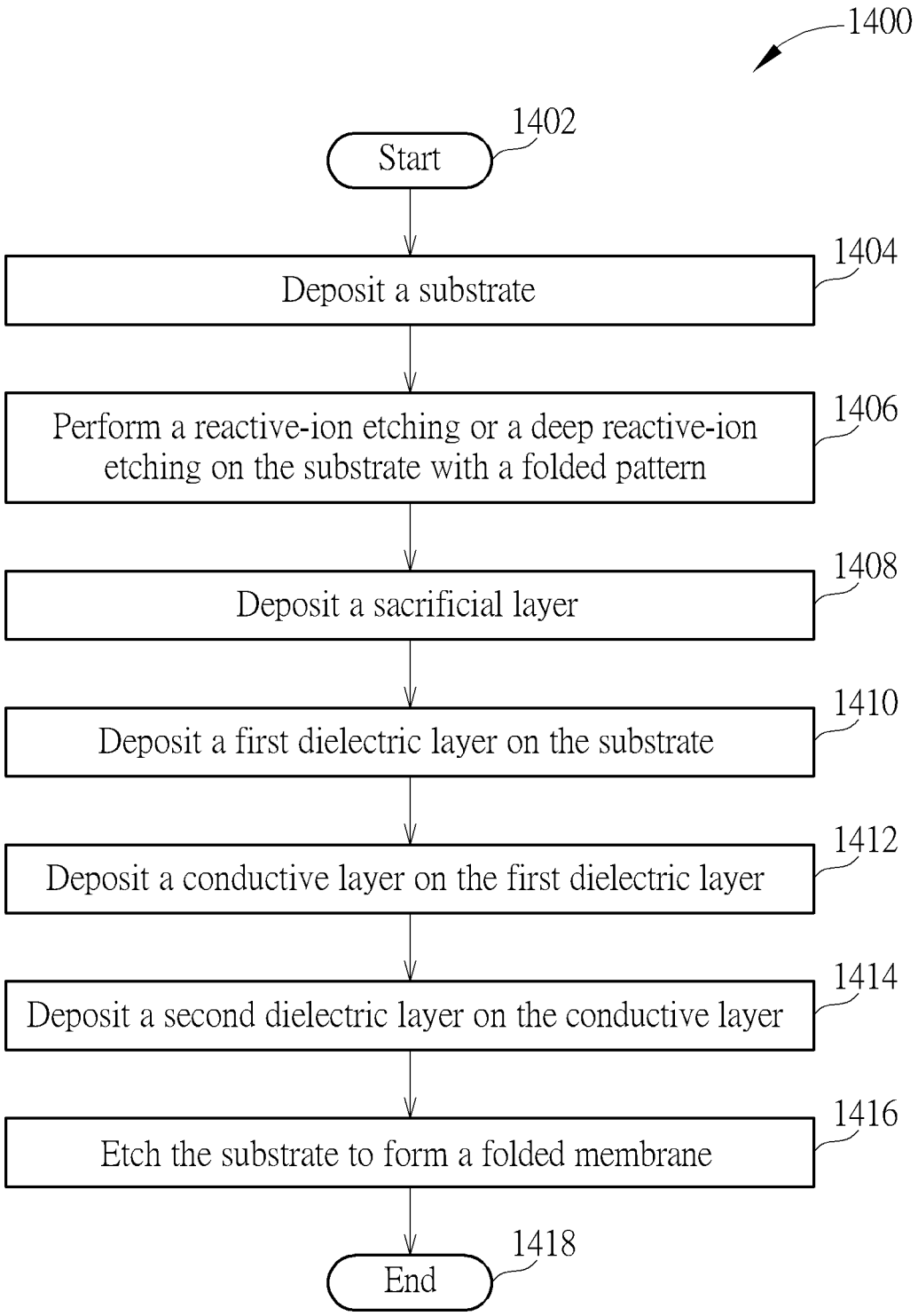
FIG. 14 is a schematic diagram of a manufacturing process for manufacturing the folded membrane of the air pulse generating element according to an embodiment of the present invention.
Figure 15:
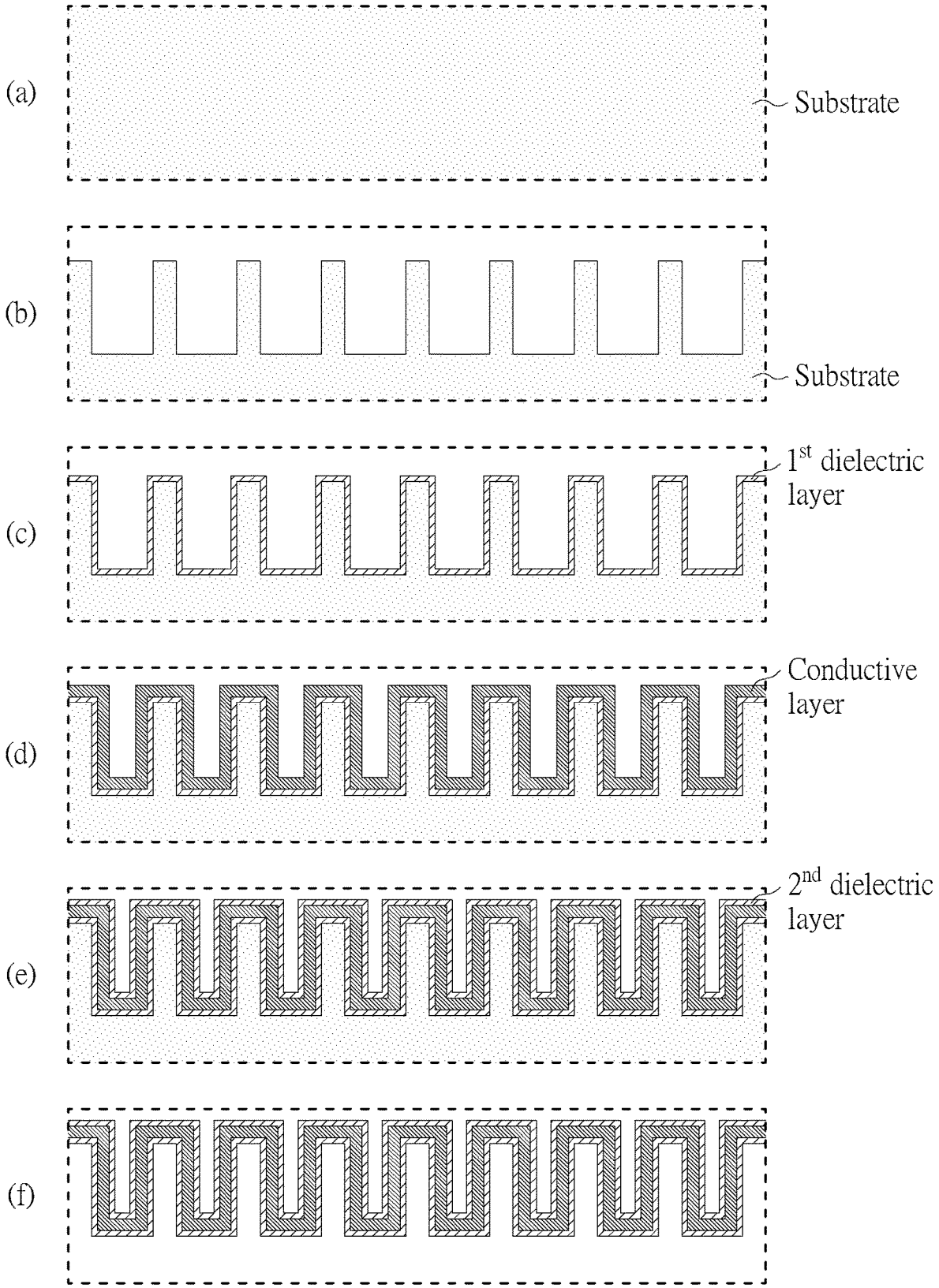
FIG. 15 is a structural diagram corresponding to the manufacturing process in FIG. 14.

Further, please refer to FIG. 14, which is a schematic diagram of a manufacturing process 1400 for manufacturing the folded membrane 110 of air pulse generating element 10 according to an embodiment of the present invention. In addition, FIG. 15 is a structural diagram corresponding to the manufacturing process 1400 shown in FIG. 14. The manufacturing process 1400 includes the following steps:

Step 1402: Start.

Step 1404: Deposit a substrate.

Step 1406: Perform a reactive-ion etching (RIE) or a deep reactive-ion etching (DRIE) on the substrate with a folded pattern.

Step 1408: Deposit a sacrificial layer.

Step 1410: Deposit a first dielectric layer on the substrate.

Step 1412: Deposit a conductive layer on the first dielectric layer.

Step 1414: Deposit a second dielectric layer on the conductive layer.

Step 1416: Etch the substrate to form a folded membrane.

Step 1418: End.

According to the manufacturing process 1400, a metallic membrane is manufactured by a thin conductive layer and isolated by two dielectric layers. First, in step 1404, which corresponds to FIG. 15(*a*), the substrate is deposited, which may be a silicon substrate. In step 1406, which corresponds to FIG. 15(*b*), the RIE or the DRIE etching is performed on the folded substrate. In step 1408, the sacrificial layer is deposited. In step 1410, which corresponds to FIG. 15(*c*), the first dielectric is deposited. In step 1412, which corresponds to FIG. 15(*d*), the conductive layer may be deposited by means of LPCVD for poly-silicon or sputter for a metal film. In step 1414, which corresponds to FIG. 15(*e*), the second dielectric layer is deposited to accomplish the folded membrane without electrical isolation. In addition, step 1408 is optional to the manufacturing process 1400. When the sacrificial layer is deposited before the depositing the first dielectric layer on the substrate, in step 1416, which corresponds to FIG. 15(*f*), the membrane 110 is released from the silicon substrate by etching the sacrificial layer after depositing the second dielectric layer on the conductive layer. Notably, the pair of the conductive and the dielectric material of the folded membrane may be Poly-Si and SiO2, Poly-Si and SiN or Metals and polymer, which are within the scope of the present invention.

Aforementioned process in FIG. 14 can be used to fabricate the electrostatic or electromagnetic actuator on folded membrane in FIG. 8. In another embodiment, please refer to FIG. 16, which is a schematic diagram of a manufacturing process 1600 for manufacturing the folded membrane with piezoelectric actuators of air pulse generating element according to an embodiment of the present invention. The manufacturing process 1600 includes the following steps:

Step 1602: Start.

Step 1604: PZT/top/bottom are deposited and patterned.

Step 1606: Frontside deep RIE etch forms silicon trench pattern with PZT protection.

Step 1608: Deep RIE etch defines backside cavity.

Step 1610: Backside deep RIE etch define trench pattern of the folded membrane.

Step 1612: End.

Figure 16:
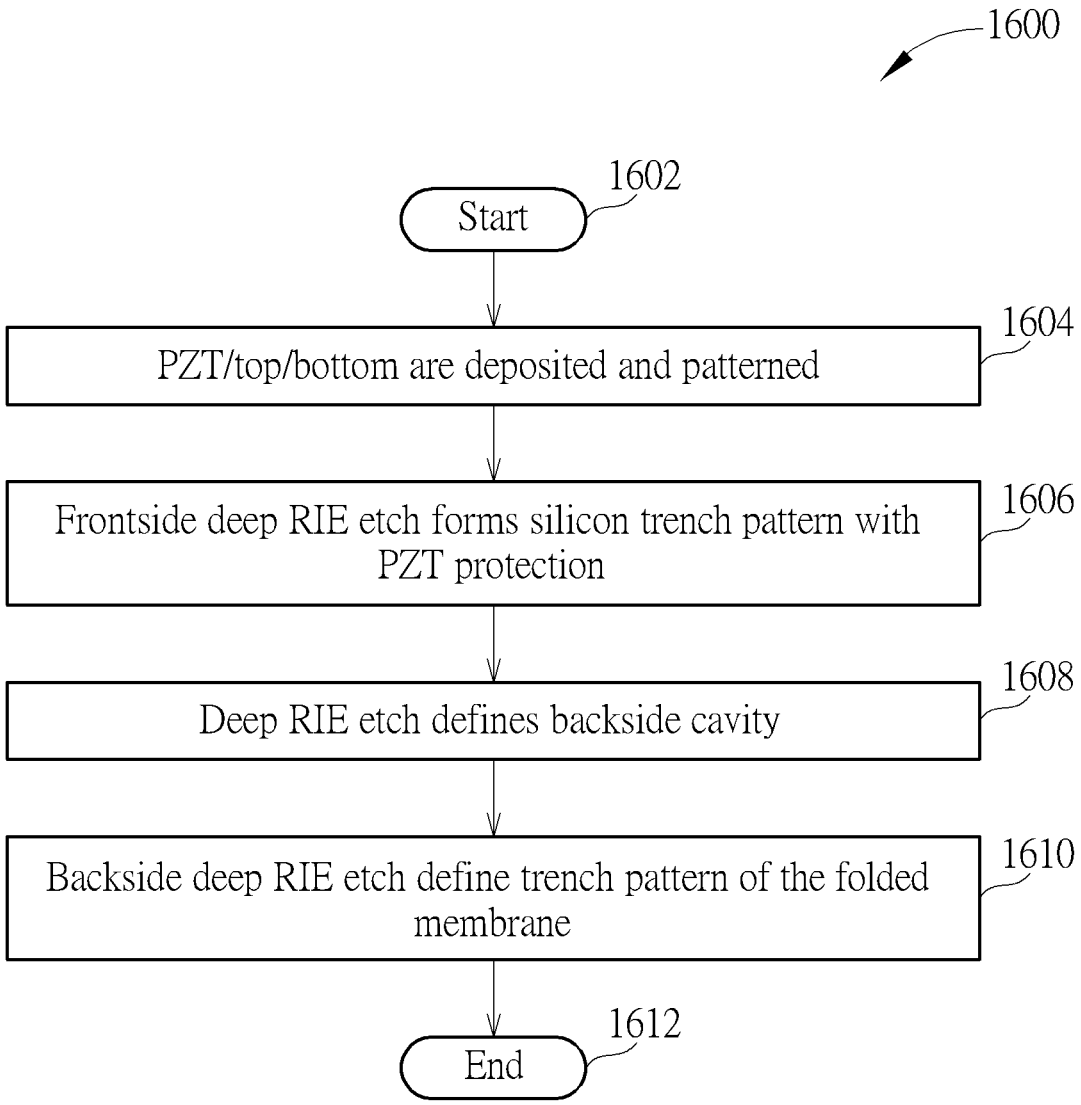
FIG. 16 is a schematic diagram of a manufacturing process for manufacturing the folded membrane with piezoelectric actuators of air pulse generating element according to an embodiment of the present invention.
Figure 17:
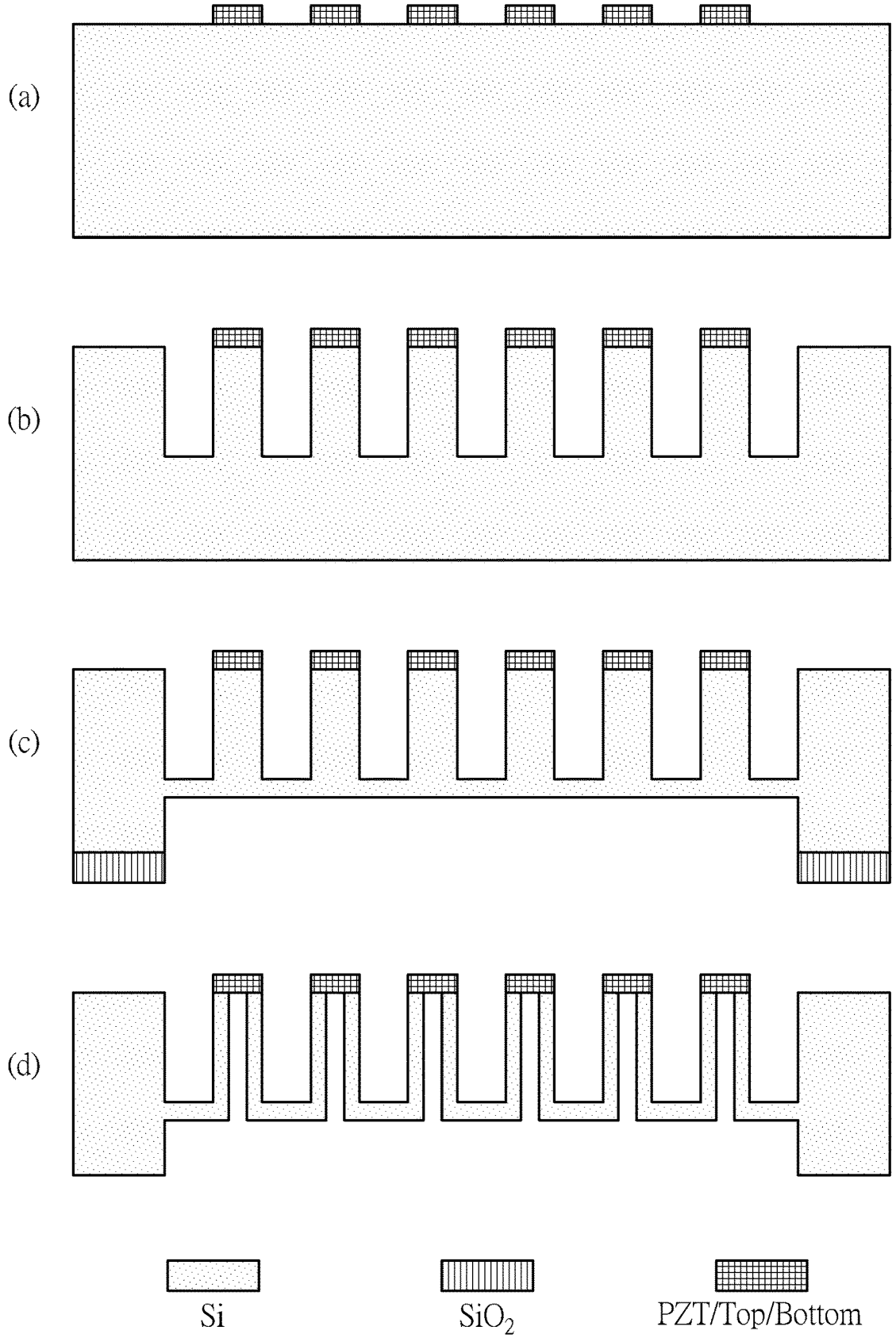
FIG. 17 is a structural diagram corresponding to the manufacturing process in FIG. 16.

In addition, FIG. 17 is a structural diagram corresponding to the manufacturing process 1600 shown in FIG. 16. FIG. 17(*a*)-17(*d*) respectively corresponds to Step 1604 to Step 1610. Notably, the piezoelectric actuators are deposited and patterned on etching silicon to fabricate piezoelectric actuator on folded membrane 110 in FIGS. 5A, 5B, 6A and 6B.

Figure 18:
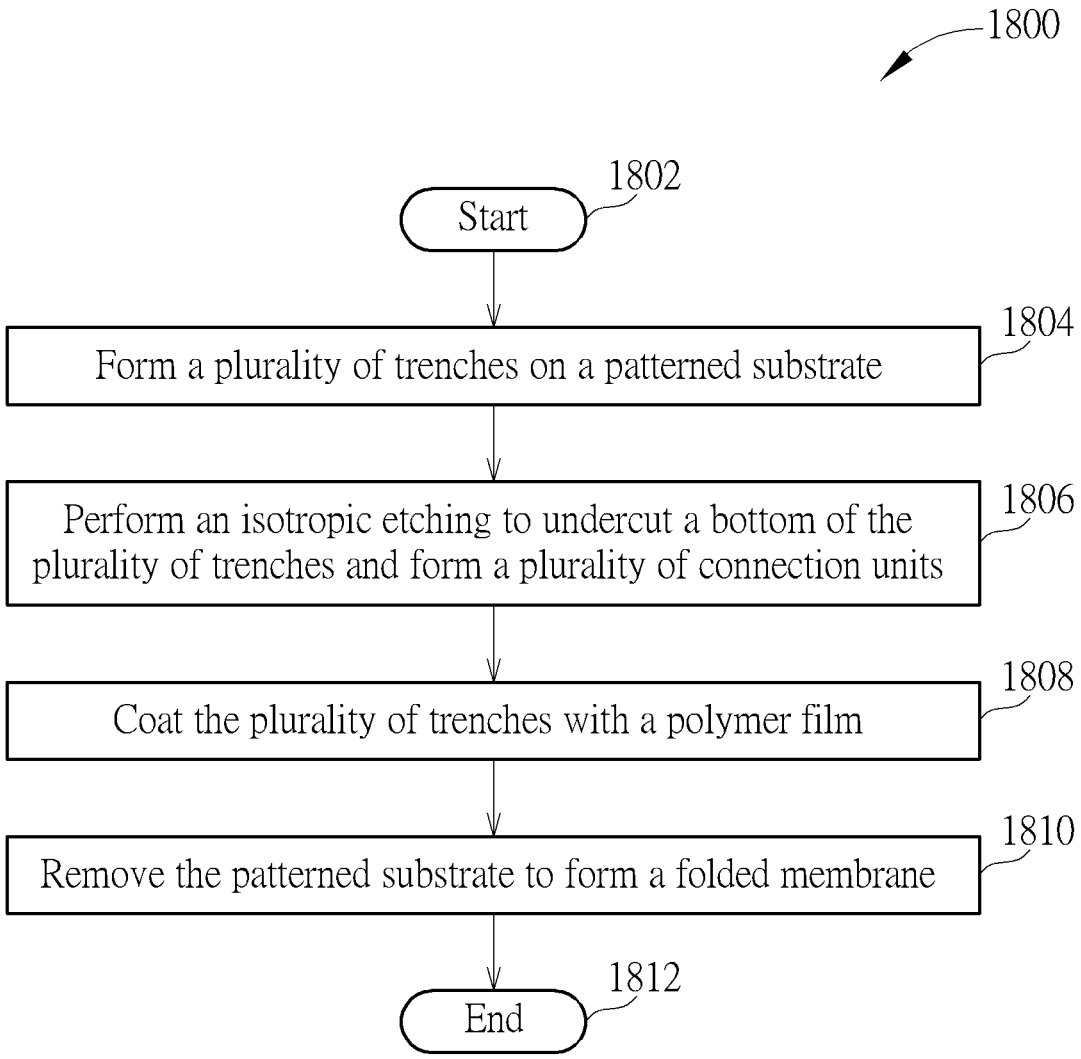
FIG. 18 is a schematic diagram of a manufacturing process for manufacturing the folded membrane of the air pulse generating element according to an embodiment of the present invention.
Figure 19:
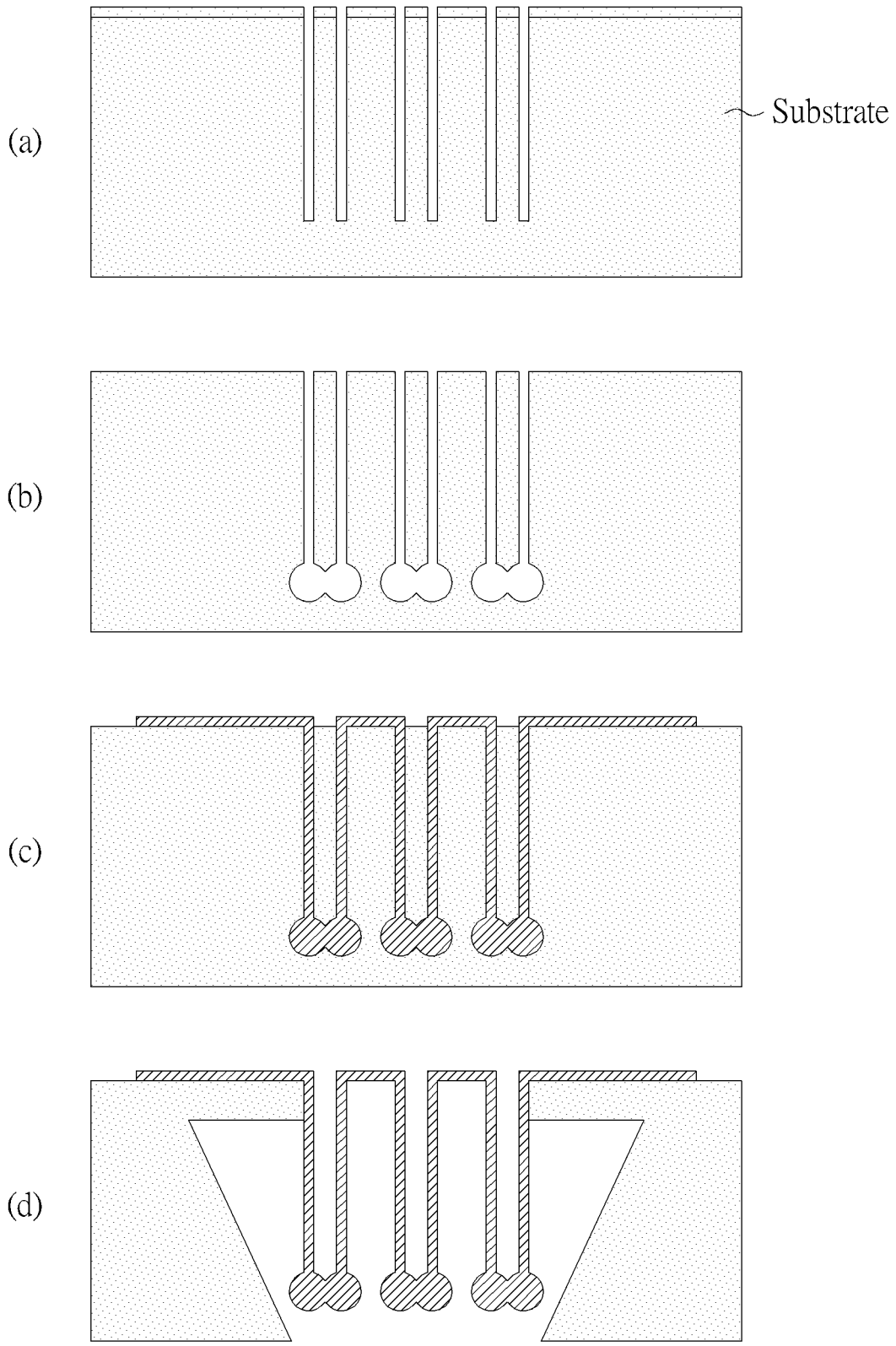
FIGS. 19 and 20 are structural diagrams corresponding to the manufacturing process in FIG. 17.

Please refer to FIG. 18, which is a schematic diagram of a manufacturing process 1800 for manufacturing the folded membrane 110 of the air pulse generating element 10 according to another embodiment of the present invention. FIG. 19 is a structural diagram corresponding to the manufacturing process 1800 shown in FIG. 18. The manufacturing process 1800 includes the following steps:

Step 1802: Start.

Step 1804: Form a plurality of trenches on a patterned substrate.

Step 1806: Perform an isotropic etching to undercut a bottom of the plurality of trenches and form a plurality of connection units.

Step 1808: Coat the plurality of trenches with a polymer film.

Step 1810: Remove the patterned substrate to form a folded membrane.

Step 1812: End.

Figure 20:
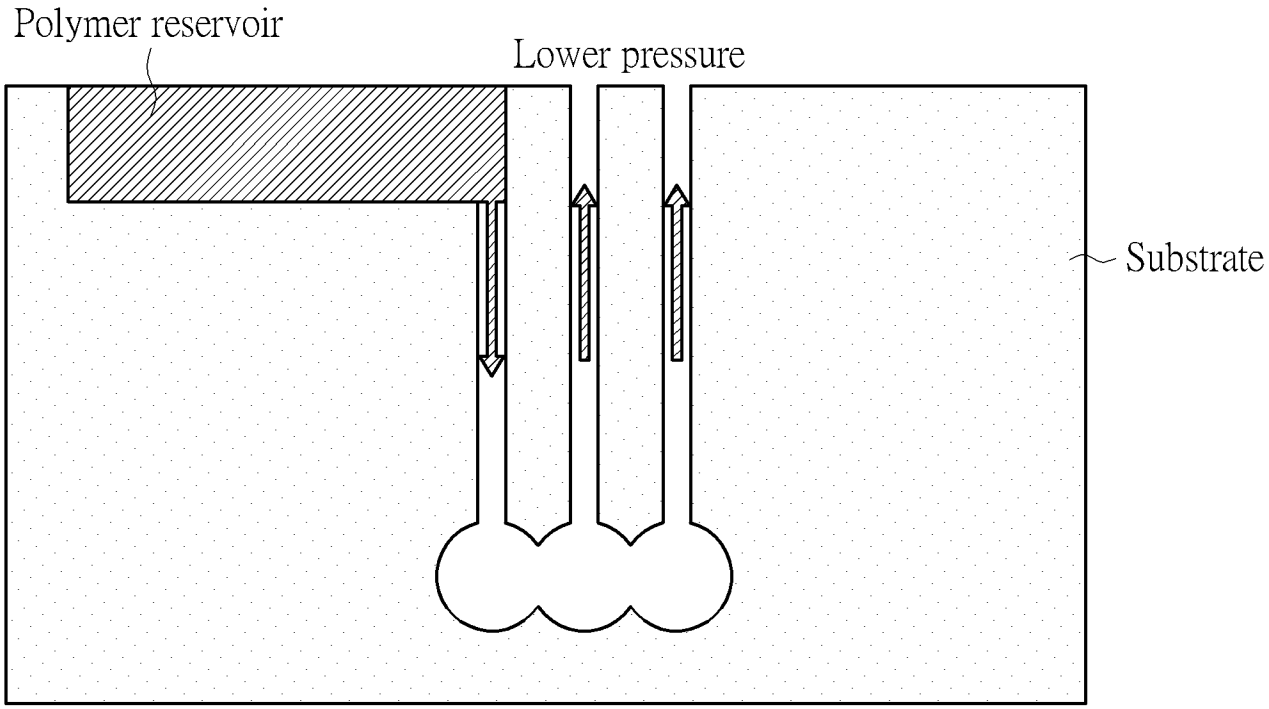

According to the manufacturing process 1800, a polymer-based folded membrane is manufactured. In step 1804, which corresponds to FIG. 19(*a*), the trenches are formed on the silicon substrate by the DRIE method or the RIE method. In step 1806, which corresponds to FIG. 19(*b*), the isotropic etching is performed to undercut the bottom of the trenches to form the connection units. In step 1808, which corresponds to FIG. 19(*c*), every two of the connection units are connected to each other when coating the trenches with the polymer film. In step 1810, which corresponds to FIG. 19(*d*), the polymer membrane is released by removing the silicon substrate. Notably, the polymer-based membrane has lower stiffness and results in larger displacement with identical driving force compared with the metallic-based membrane. In addition, other materials of the polymer-based membrane may be implemented such as dry film, Benzocyclobutene (BCB), Parylene(Poly-p-xylene) for non-conductive type; Polydimethylsiloxane (PDMS), Poly-3,4-Ethylenedioxythiophene (PEDOT), polyaniline (PANI), Polythiophenes (PTs), poly(p-phenylene sulfide) (PPS), poly (p-phenylene vinylene) (PPV) and Poly(acetylene) (PAC) for conductive type. There are several polymer coating methods including spin coating, spray coating, film laminating, and polymer filling. As shown in FIG. 20, the polymer filling has polymer reservoir, which is connected to trenches formed by the process of DRIE and isotropic etching to undercut the bottom of the trenches. After the injection of polymer liquid into the polymer reservoir, lower pressure is created and the polymer flows into the trenches to form a folded membrane with high aspect ratio.

Therefore, the present invention provides an air pulse generating element and manufacturing method, and more particularly, which is capable of increasing the membrane area, producing high fidelity sound and enough sound pressure.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An air pulse generating element, comprising:

a front faceplate;

a back faceplate;

a folded membrane, configured to form a front chamber and a back chamber, and comprising a plurality of membrane units; wherein the plurality of membrane units are parallel and sequentially connected and an end of the folded membrane is connected to the back faceplate and another end of the folded membrane is connected to the front faceplate; and a plurality of valves controlling a plurality of air flow channels between the front chamber toward either a front space or a back space, and between the back chamber toward either the front space or the back space;

wherein the plurality of membrane units are configured to perform horizontal deformation to squeeze air in and out of the front or back chamber with operations of the plurality of valves controlling the direction of an air pulse toward the front space or the back space.

2. The air pulse generating element of claim 1, further comprising a plurality of actuators, each formed on a side of a membrane unit of the plurality of membrane units.

3. The air pulse generating element of claim 2, wherein the plurality of actuators are mounted on the plurality of membrane units, such that the plurality of membrane units flexibly perform the horizontal deformation.

4. The air pulse generating element of claim 2, wherein the plurality of actuators are electrostatic actuators with a plurality of electrodes, such that the plurality of membrane units perform the horizontal deformation when a plurality of driving charges are applied on the plurality of electrodes.

5. The air pulse generating element of claim 2, wherein when the plurality of actuators are piezoelectric actuators with a plurality of electrodes, the plurality of membrane units perform the horizontal deformation when a plurality of driving charges are applied on the plurality of electrodes.

6. The air pulse generating element of claim 2, wherein when the folded membrane is incorporated with electromagnetic actuator and a current flows along the folded membrane, the plurality of membrane units perform the horizontal deformation.

7. The air pulse generating element of claim 2, wherein a driving voltage is applied to each of a plurality of actuators of the air pulse generating element, such that the air pulse generating element generates a plurality of air pulses in response to the driving voltage; a plurality of air pulses are at a pulse rate, and the pulse rate of the plurality of air pulses is higher than a maximum audible frequency.

8. The air pulse generating element of claim 7, wherein the pulse rate of the plurality of air pulses is at least twice higher than a maximum frequency of an input audio signal to be reproduced.

9. The air pulse generating element of claim 7, wherein the pulse rate of the plurality of air pulses is at least twice higher than a maximum audible frequency.

10. The air pulse generating element of claim 1, wherein a first front valve is controlled by a first front valve-controlling signal to control an airflow through the front faceplate; a first back valve, controlled by a first back valve-controlling signal to control the airflow through the back faceplate; a second front valve, controlled by a second front valve-controlling signal to control the airflow through the front faceplate; and a second back valve, controlled by a second back valve-controlling signal to control the airflow through the back faceplate.

11. The air pulse generating element of claim 10, wherein the first front valve-controlling signal equals the second back valve-controlling signal, and the first back valve-controlling signal equals the second front valve-controlling signal.

12. The air pulse generating element of claim 1, wherein the air pulse generating element receives an input audio signal, and an amplitude and a polarity of each air pulse generated by the air pulse generating element are related to a amplitude and a polarity of a time-sample of the input audio signal.

13. The air pulse generating element of claim 1, wherein a direction of an air mass velocity within a pulse cycle is in a front-to-back direction or a back-to-front direction regardless an initial position of the folded membrane, and a plurality of valve-controlling signals are generated to the plurality of valves to perform an open-and-close movement.

14. The air pulse generating element of claim 13, wherein the horizontal deformation performed by the plurality of membrane units and the open-and-close movement performed by the plurality of valves are mutually synchronized.

* * * * *